US009613580B2

(12) United States Patent
Huang

(10) Patent No.: US 9,613,580 B2
(45) Date of Patent: Apr. 4, 2017

(54) DISPLAY DEVICE, TIMING CONTROLLER, AND IMAGE DISPLAYING METHOD

(71) Applicants: HISENSE HIVIEW TECH CO., LTD, Qingdao, Shandong (CN); HISENSE USA CORPORATION, Suwanee, GA (US)

(72) Inventor: Shunming Huang, Shandong (CN)

(73) Assignees: HISENSE HIVIEW TECH CO., LTD, Qingdao, Shandong (CN); HISENSE USA CORPORATION, Suwanee, GA (US)

( * ) Notice: Subject to any disclaimer, the term of this patent is extended or adjusted under 35 U.S.C. 154(b) by 227 days.

(21) Appl. No.: 14/145,361

(22) Filed: Dec. 31, 2013

(65) Prior Publication Data

US 2014/0362073 A1 Dec. 11, 2014

(30) Foreign Application Priority Data

Jun. 6, 2013 (CN) ..... 2013 1 0223124

(51) Int. Cl.
*G09G 3/36* (2006.01)

(52) U.S. Cl.
CPC ... *G09G 3/3674* (2013.01); *G09G 2310/0229* (2013.01)

(58) Field of Classification Search
CPC .. G09G 3/2022; G09G 3/2092; G09G 3/3614; G09G 3/3266; G09G 3/3688; G09G 3/3648; G09G 3/3677; G09G 3/3233; G09G 3/3611; G09G 3/3291; G09G 3/3659; G09G 3/3283; G09G 3/3275; G09G 3/3258; G09G 3/3685; G09G 3/3241; G09G 3/3674; G09G 2300/0861; G09G 2300/0842;

(Continued)

(56) References Cited

U.S. PATENT DOCUMENTS

2007/0089000 A1* 4/2007 Shin ..... G09G 3/3266 714/726
2010/0118013 A1* 5/2010 Kitayama ..... G09G 3/3614 345/211

(Continued)

FOREIGN PATENT DOCUMENTS

CN 1783189 A 6/2006
CN 102789769 11/2012

(Continued)

OTHER PUBLICATIONS

English Language Translation of Description of CN 102789769 A (Published: Nov. 2012); Author: Shunming Huang et al.*

*Primary Examiner* — Nalini Mummalaneni
(74) *Attorney, Agent, or Firm* — Tim Tingkang Xia, Esq.; Locke Lord LLP

(57) ABSTRACT

Aspects of the present invention relate to a display device, a timing controller, and an image display method. When a frame of an input image signal including an odd-field signal and an even-field signal is received, a timing controller outputs a gate scanning clock (GCK) signal and an output enable (OE) signal in an interlaced scanning manner, to separately scan the odd-field image and the even-field image in the interlaced scanning manner in real time. The interlaced scanning manner is used for the interlaced signal, thereby saving a storage equipped in a converter.

19 Claims, 23 Drawing Sheets

(58) Field of Classification Search
CPC ... G09G 2300/0852; G09G 2300/0809; G09G 2300/0814; G09G 2300/0804; G09G 2300/0426; G09G 2310/0224; G09G 2310/06; G09G 2310/063; G09G 2310/08; G09G 2310/027; G09G 2310/0262; G09G 2310/0286; G09G 2310/0297; G09G 2310/0251; G09G 2310/0205; G09G 2310/0216; G09G 2310/0283; G09G 2320/0233; G09G 2320/043; G09G 2320/0209; G09G 2320/0285; G09G 2320/0238; G09G 2320/0257; G09G 2320/0673; G09G 2320/0204; G09G 2320/0229; G09G 2340/0435; G09G 2340/16; G09G 2370/08; G09G 2360/18; G09G 5/006
See application file for complete search history.

(56) References Cited

U.S. PATENT DOCUMENTS

2010/0277463 A1* 11/2010 Yen ..... G09G 3/20 345/213
2014/0002431 A1* 1/2014 Shibata ..... G09G 3/3614 345/208

FOREIGN PATENT DOCUMENTS

CN 102789769 A * 11/2012
JP WO 2012124660 A1 * 9/2012 ..... G09G 3/3614

* cited by examiner

DISPLAY DEVICE, TIMING CONTROLLER, AND IMAGE DISPLAYING METHOD

CROSS-REFERENCE TO RELATED APPLICATION

This application claims the priority to Chinese Patent Application No. 201310223124.1, filed on Jun. 6, 2013, in the State Intellectual Property Office of P.R. China, which is hereby incorporated herein in its entirety by reference.

FIELD OF THE INVENTION

The present invention relates generally to display technology, and more particularly to a display device, a timing controller, and an image displaying method.

BACKGROUND OF THE INVENTION

Currently, video data may be processed in a progressive video format or an interlaced video format. Conventionally, a display screen mostly uses the progressive scanning manner. In some cases, an interlaced-to-progressive format converter needs to be disposed at a front end of display processing such that the display screen is compatible to the interlaced format signal. The format converter may be disposed in a timing control circuit of the display screen, or may be disposed in a motherboard circuit of a display device. However, the conventional interlaced and progressive format converter generally requires a data storage unit for buffering the received data signal. The data storage unit is generally formed by a storage and hardware parts of a periphery auxiliary circuit, which cannot be removed from the display device to save space and cost. In other words, the required storage and hardware parts of the periphery auxiliary circuit occupy certain space in the display device and increase the cost of the display device.

Therefore, a heretofore unaddressed need exists in the art to address the aforementioned deficiencies and inadequacies.

SUMMARY OF THE INVENTION

In view of the defects in the prior art, the present invention provides a novel interlaced scanning drive technology, which can implement interlaced scanning display when an interlaced-format signal is received, thereby saving a storage and a periphery auxiliary circuit equipped in a format converter in the prior art.

In one aspect, the present invention provides a display device, which includes: a liquid crystal panel; a gate drive circuit, for providing the liquid crystal panel with a gate drive signal, and a data drive circuit, for providing the liquid crystal panel with a data drive signal; and a timing controller, for receiving an input signal comprising an odd-field signal and an even-field signal, providing the data drive circuit with a data control signal and a data signal, and providing the gate drive circuit with a gate control signal including an output enable (OE) signal and a gate scanning clock (GCK) signal, where in a data signal period in one line, the GCK signal includes two clock pulses, and the OE signal includes one pulse signal. In scanning the odd field, at a time period corresponding to a first clock pulse in the two clock pulses, the gate drive circuit outputs a high potential gate drive signal to drive an odd-line gate bus, and at a time period corresponding to a second clock pulse in the two clock pulses, the gate drive circuit outputs a low potential gate drive signal to drive an even-line gate bus; and in scanning the even field, at a time period corresponding to a first clock pulse in the two clock pulses, the gate drive circuit outputs a low potential gate drive signal to drive an odd-line gate bus, and at a time period corresponding to a second clock pulse in the two clock pulses, the gate drive circuit outputs a high potential gate drive signal to drive an even-line gate bus.

In this technical solution, in receiving an odd-field image, in a data period in each line, the GCK signal generated by the timing controller includes two clock pulses. When the gate drive circuit scans the odd-line gate bus, at a time period corresponding to a first clock pulse in the two clock pulses, a high potential gate drive signal is output and an odd-line gate bus is turned on; when the gate drive circuit scans the even-line gate bus, at a time period corresponding to a second clock pulse, a low potential gate drive signal is output and an even-line gate bus is turned off. In this way, the data drive circuit can write a line of data in an odd line, so as to refresh the odd-line image on the display screen by receiving the odd-field image. In receiving an even-field image, when the gate drive circuit scans the odd-line gate bus, at the time period corresponding to the first clock pulse in the two clock pulses, a low potential gate drive signal is output and an odd-line gate bus is turned off; when the gate drive circuit scans the even-line gate bus, at the time period corresponding to the second clock pulse, a high potential gate drive signal is output, and an even-line gate bus is turned on. In this way, the data drive circuit can write a line of data in an even line, so as to refresh the even-line image on the display screen by receiving the even-field image. In receiving an interlaced image signal, an interlaced image is scanned and displayed on the display screen, which can save a storage and a periphery auxiliary circuit equipped in a converter.

In another aspect, the present invention provides a display device, which includes: a liquid crystal panel; a gate drive circuit, for providing the liquid crystal panel with a gate drive signal, and a data drive circuit, for providing the liquid crystal panel with a data drive signal; and an interlaced and progressive format determination unit, for outputting a first control signal when judging that an input signal is an interlaced image signal including an odd-field signal and an even-field signal, and outputting a second control signal when judging that the input signal is a progressive image signal; and a timing controller, for receiving the input signal, providing the data drive circuit with a data control signal and a data signal, and providing the gate drive circuit with a gate control signal including an OE signal and a GCK signal; where when receiving the first control signal, in a data signal period in one line, the timing controller generates the GCK signal including two clock pulses and generates the OE signal including one pulse signal; in scanning the odd field, at a time period corresponding to a first clock pulse in the two clock pulses, the gate drive circuit outputs a high potential gate drive signal to drive an odd-line gate bus, and at a time period corresponding to a second clock pulse in the two clock pulses, outputs a low potential gate drive signal to drive an even-line gate bus; in scanning the even field, at a time period corresponding to the first clock pulse in the two clock pulses, the gate drive circuit outputs a low potential gate drive signal to drive an odd-line gate bus, and at a time period corresponding to the second clock pulse in the two clock pulses, outputs a high potential gate drive signal to drive an even-line gate bus; and when receiving the second control signal, in the data signal period in one line, the timing processing unit outputs the GCK signal including one clock pulse and a first-potential OE signal.

In this technical solution, in one aspect, in receiving an interlaced image signal, when an odd-field image is scanned, and in a data period in each line, the GCK signal generated by the timing controller includes two clock pulses. When the gate drive circuit scans the odd-line gate bus, at a time period corresponding to a first clock pulse in the two clock pulses, a high potential gate drive signal is output and an odd-line gate bus is turned on; when the gate drive circuit scans the even-line gate bus, at a time period corresponding to a second clock pulse, a low potential gate drive signal is output and an even-line gate bus is turned off. In this way, the data drive circuit can write a line of data into an odd line, so as to refresh the odd-line image on the display screen by receiving the odd-field image. In receiving an even-field image, when the gate drive circuit scans the odd-line gate bus, at the time period corresponding to the first clock pulse in the two clock pulses, a low potential gate drive signal is output and an odd-line gate bus is turned off; when the gate drive circuit scans the even-line gate bus, at the time period corresponding to the second clock pulse, a high potential gate drive signal is output, and an even-line gate bus is turned on. In this way, the data drive circuit can write a line of data into an even line, so as to refresh the even-line image on the display screen by receiving the even-field image. In another aspect, in receiving a progressive image, the timing controller outputs a GCK signal and a first-potential OE signal in a data period in one line. In this way, the gate drive circuit outputs a corresponding a gate drive signal at a time period corresponding to each GCK signal, and outputs a high potential gate drive signal at a time period corresponding to each GCK signal to turn on a gate bus in each line. In this way, the data drive circuit can correspondingly write data into each line, so as to refresh the image progressively on the display screen by receiving a progressive image. Therefore, this technical solution can implement a compatible interlaced scanning manner and a progressive scanning manner.

In still another aspect, the present invention provides an image display method, applied to a display device driven by a gate drive signal and a data drive signal, where steps of the method include: S200: a timing controller receiving an input signal comprising an odd-field signal and an even-field signal; S400: generating a gate control signal, a data control signal, and a data signal, where the gate control signal includes an OE signal and a GCK signal, in a data signal period in one line, the GCK signal includes two clock pulses, and the OE signal includes one pulse signal; and S600: a gate drive circuit processing the OE signal and the GCK signal, to generate the gate drive signal; where if in scanning an odd field, in the gate drive signal for scanning an odd-line gate bus, the potential is high at a time period corresponding to a first clock pulse in the two clock pulses, an odd-line gate bus is turned on, and a line of data drive signals are written in; if in the gate drive signal for scanning an even-line gate bus, the potential is low at a time period corresponding to a second clock pulse in the two clock pulses, an even-line gate bus is turned off; and if in scanning an even field, in the gate drive signal for scanning an odd-line gate bus, the potential is low at a time period corresponding to a first clock pulse in the two clock pulses, an odd-line gate bus is turned off; if in the gate drive signal for scanning an even-line gate bus, the potential is low at a time period corresponding to a second clock pulse in the two clock pulses, an even-line gate bus is turned on, and a line of data drive signals are written in.

In this technical solution, in receiving an odd-field image, in a data period in one line, the GCK signal generated by the timing controller includes two clock pulses. When the gate drive circuit scans the odd-line gate bus, at a time period corresponding to a first clock pulse in the two clock pulses, a high potential gate drive signal is output and an odd-line gate bus is turned on; when the gate drive circuit scans the even-line gate bus, at a time period corresponding to a second clock pulse, a low potential gate drive signal is output and an even-line gate bus is turned off; the data drive circuit writes a line of data into the odd line, so as to refresh the odd-line image on the display screen by receiving the odd-field image. In receiving an even-field image, when the gate drive circuit scans the odd-line gate bus, at the time period corresponding to the first clock pulse in the two clock pulses, a low potential gate drive signal is output and an odd-line gate bus is turned off; when the gate drive circuit scans the even-line gate bus, at the time period corresponding to the second clock pulse, a high potential gate drive signal is output, and an even-line gate bus is turned on; the data drive circuit writes a line of data into the even line, so as to refresh the even-line image on the display screen by receiving the even-field image. In receiving an interlaced image signal, an interlaced image is scanned and displayed on the display screen, which can save a storage and a periphery auxiliary circuit equipped in a converter.

These and other aspects of the invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION OF THE INVENTION

Figure 1:
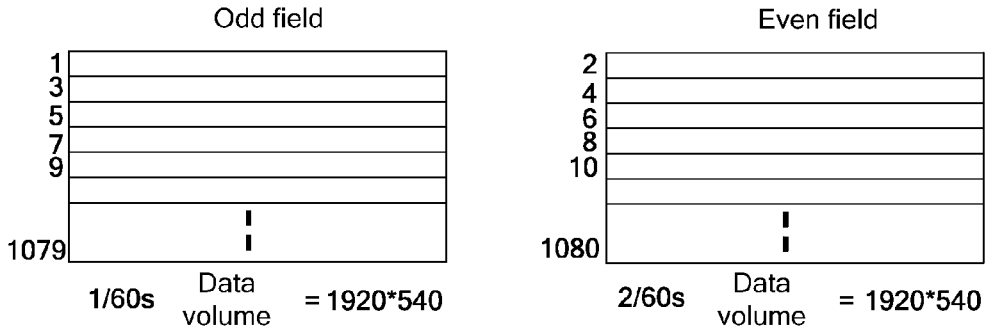
FIG. 1 is a schematic diagram showing 1080i interlaced scanning.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are configured to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, although the terms first, second, third etc. may be used herein to describe various elements, components, regions, layers and/or sections, these elements, components, regions, layers and/or sections should not be limited by these terms. These terms are only configured to distinguish one element, component, region, layer or section from another element, component, region, layer or section. Thus, a first element, component, region, layer or section discussed below could be termed a second element, component, region, layer or section without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

As used herein, the term "unit", "module" or "submodule" may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term unit, module or submodule may include memory (shared, dedicated, or group) that stores code executed by the processor.

The description will be made as to the embodiments of the invention in conjunction with the accompanying drawings in FIGS. 1-25. It should be understood that specific embodiments described herein are merely used for explaining the invention, but are not intended to limit the invention. In accordance with the purposes of this disclosure, as embodied and broadly described herein, this invention, in one aspect, relates to a display device. In another aspect, the present invention relates to an image displaying method. Additionally, a further aspect of the present invention relates to a timing controller.

FIG. 1 is a schematic diagram showing 1080i interlaced scanning. As shown in FIG. 1, an interlaced video signal includes signals to display odd lines and even lines of an image, where a first field video signal is configured to scan an image in odd lines such as the first, third, fifth, seventh, and ninth lines, and a second field video signal is configured to scan the image in even lines such as the second, fourth, sixth, eighth, and tenth lines. Alternatively, the first-field video signal first may scan the even lines and the second-field video signal may scan the odd lines. In this way, a single frame of the image includes odd-line and even-line scanning signals in the same frame. For example, when a first field odd-line video signal is received, the odd lines are scanned on a display screen, while the even lines maintain a previous field even-line signal scanned image. Then, when a second field even-line video signal is received, the even lines are scanned on the display screen, while the odd lines maintain the previous field odd-line signal scanned image. A frame of image is displayed by using the two-field interlaced scanning signals.

Figure 2:
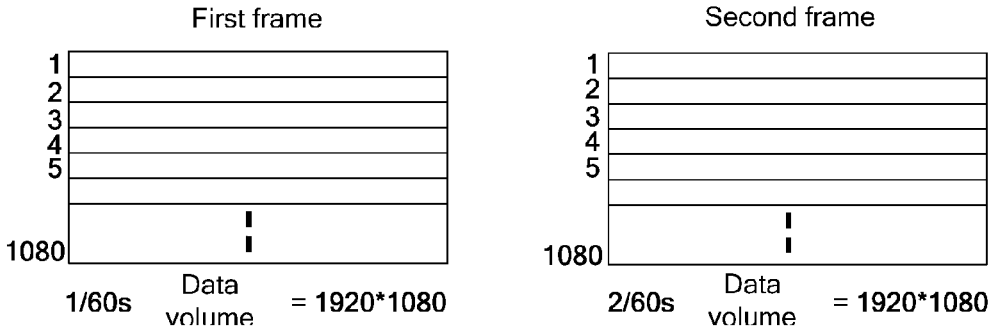
FIG. 2 is a schematic diagram showing 1080P progressive scanning.

FIG. 2 is a schematic diagram showing 1080P progressive scanning. As shown in FIG. 2, the progressive scanning manner is different from the interlaced scanning manner. The progressive scanning manner adopts a sequential scanning process, where a field progressive video signal is received, and scanning is performed sequentially through the first, the second, the third line, etc. of the display screen. The scanning of the frame of image is completed by using one field video signal. A difference between the interlaced and progressive scanning manners exists in that the progressive scanning manner has a frame frequency twice of that of the interlaced scanning manner, such that an image frame generated by the interlaced scanning manner has fewer flashes than that of the progressive scanning manner.

Figure 3:
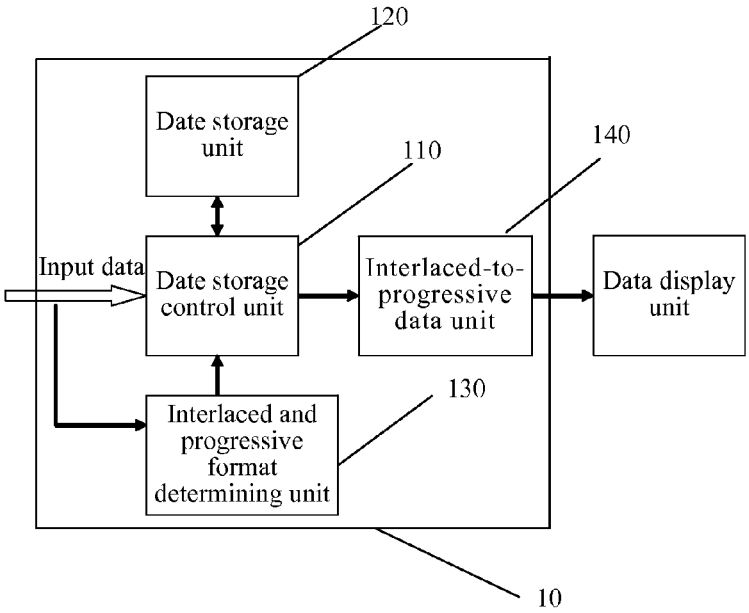
FIG. 3 is a block diagram of a progressive-to-interlaced format converter according to one embodiment of the present invention.

FIG. 3 is a block diagram of a progressive-to-interlaced format converter according to one embodiment of the present invention. As shown in FIG. 3, a format converter 10 includes an interlaced and progressive format determination unit 130, a data storage control unit 110, a data storage unit 120, and an interlaced-to-progressive data unit 140. The interlaced and progressive format determination unit 130 predetermines whether a received video data signal is in an interlaced format or a progressive format, and outputs a control signal to the data storage control unit 110. If the video data signal format is in the interlaced format, the interlaced and progressive format determination unit 130 outputs a first control signal to the data storage control unit 110, and the data storage control unit 110 controls the video data signal to be buffered in the data storage unit 120. Then, video data signals in two consecutive fields of a frame of image are simultaneously output to the interlaced-to-progressive data unit 140 for combined processing.

Figure 4:
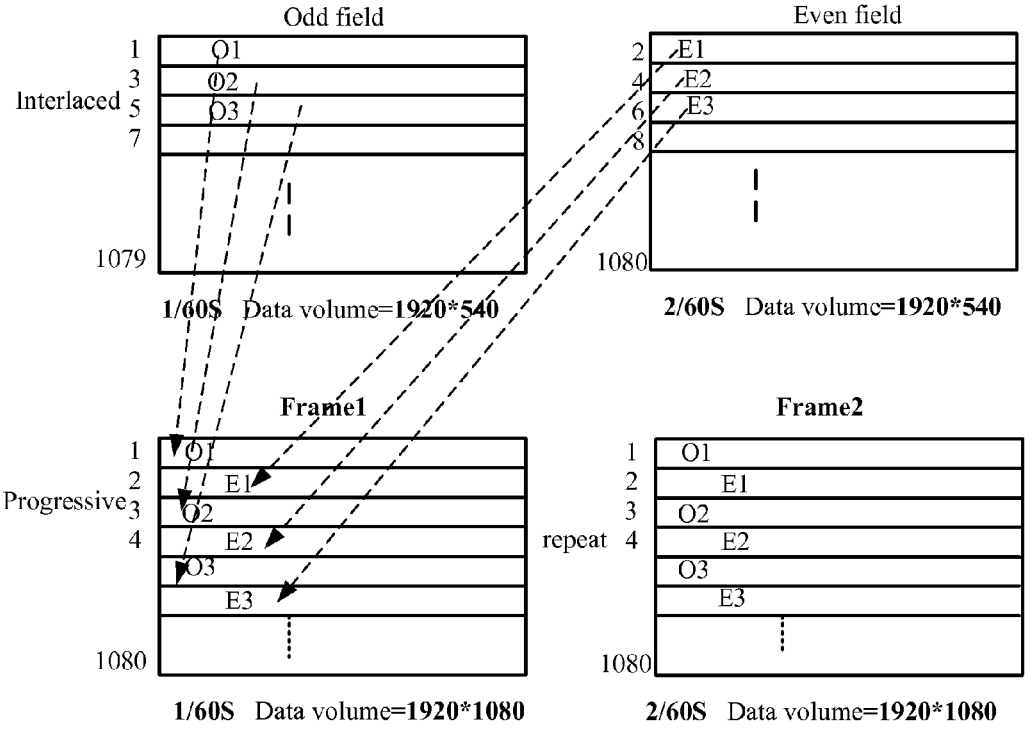
FIG. 4 is a schematic view showing that a progressive format is converted to an interlaced format according to one embodiment of the present invention.

FIG. 4 is a schematic view showing that a progressive format is converted to an interlaced format according to one embodiment of the present invention. As shown in FIG. 4, to display a frame of 1920*1080/60 Hz image, an interlaced video signal in a first 1920*540 odd field On and an interlaced video signal in a second 1920*540 even field En need to be received. At least the first field interlaced data signal is buffered in the data storage unit 120. Then, the buffered first-field interlaced data signal and the second-field interlaced data signal are input together to the data interlaced-to-progressive unit 140 for format conversion. The interlaced-to-progressive data unit 140 combines the two fields of data signals into one field progressive data signal, where the odd field On in the progressive data signal corresponds to the odd lines and the even field En corresponds to the even lines. To maintain a field frequency of the progressive data signal consistent to a refreshing frequency of the display screen, the interlaced-to-progressive data unit 140 performs a frequency-doubling process on the combined progressive data signal. For example, the combined progressive data signal is repeated to form two consecutive fields of 1920*1080P/60 Hz progressive data signals which are the same, and the two consecutive fields of the combined progressive data signal are output to perform refreshing and scanning.

In certain embodiments, however, as discussed above, to use the interlaced and progressive format converter as shown in FIG. 3, at least the data storage unit 120 is required for buffering the received data signal. The data storage unit 120 is generally formed by a storage and hardware parts of a periphery auxiliary circuit, which cannot be removed from the display device to save space and cost.

Embodiment 1

I. Overall Structure and Working Method of the Embodiment

Figure 5:
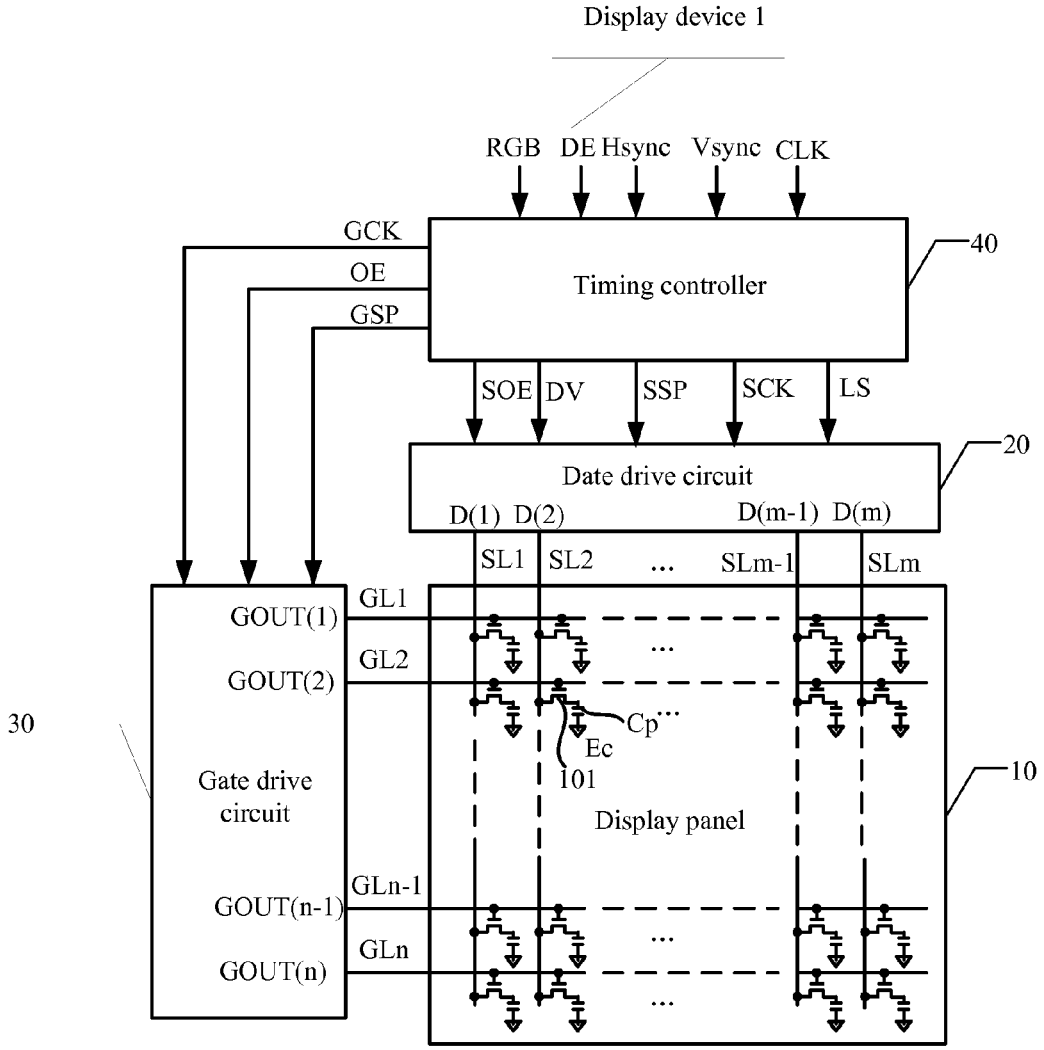
FIG. 5 is a block diagram of an overall structure of a liquid crystal display device according to one embodiment of the present invention.

FIG. 5 is a block diagram of an overall structure of a liquid crystal display device according to one embodiment of the present invention. As shown in FIG. 5, the liquid crystal display device 1 includes a power source circuit (not shown), a backlight source (not shown), a liquid crystal panel 10, a data drive circuit 20, a gate drive circuit 30, and a timing controller 40. The power source circuit supplies power for the display device 1. The backlight source is a light source providing light to the liquid crystal panel of the display device 1 for displaying an image. The gate drive circuit 30 is configured to provide a gate drive signal to the liquid crystal panel 10 with, to drive a gate bus in each line on the liquid crystal panel 10 to sequentially turn on; and the data drive circuit 20 is used for providing the liquid crystal panel 10 with a data drive signal, so as to output the data drive signal to the liquid crystal panel 10 at a time period when the gate bus in a corresponding line is turned on, to provide image display data.

The timing controller 40 receives video data input signals obtained after a motherboard or a system on a chip (SOC) decodes a video signal, where the video data input signal includes an image signal (RGB), a data enable (DE) signal, a horizontal synchronization signal (Hsync), a vertical synchronization signal (Vsync), and a clock signal. The timing controller 40 generates a data control signal and a data signal (DV) by using one part of the video data input signals, and outputs the data control signal and the data signal to the data drive circuit 20, where the data control signal includes a source start pulse (SSP) signal, a source clock (SCK) signal, a latch signal (LS), and a signal output enable (SOE). Furthermore, the timing controller 40 generates a gate control signal by using the other part of the video data input signals, and outputs the gate control signal to the gate drive circuit 30, where the gate control signal includes a gate start pulse (GSP) signal, an output enable (OE) signal, and a gate scanning clock (GCK) signal.

The display panel 10 has a pixel circuit. The pixel circuit includes multiple (specifically, m lines of) source data buses (i.e., video signal lines) SL1~SLm and multiple (specifically, n lines of) gate buses (i.e., line scanning signal lines) GL1~GLn. Multiple (mxn) pixel constitution portions are disposed at intersections of the source data buses SL1~SLm and the gate buses GL1~GLn, and the pixel constitution portions are disposed in a matrix shape to form a pixel array. Each pixel constitution portion includes a thin film transistor 101, and the (i×j)th thin film transistor 101 is provided on an intersection of a gate terminal, the i-th bus in the gate buses GL1~GLn, and the j-th bus in the source data buses SL1~SLm. The gate terminal of the thin film transistor 101 is connected to the i-th bus in the gate buses GL1~GLn, and a source data terminal of the thin film transistor 101 is connected to the j-th bus in the source data buses SL1~SLm. The i-th bus in the gate buses GL1~GLn provides a turn-on signal to the thin film transistor 101, and the j-th bus in the source data buses SL1~SLm provides a data signal to the thin film transistor 101. A pixel electrode is connected to a drain terminal of the thin film transistor 101.

The data drive circuit 20 receives the data signal (DV), the SSP signal, the SCK signal, the latch signal (LS), and the SOE signal output by the timing controller 40, and outputs these signals to the source data buses SL1~SLm to apply a data drive signal D(1)~D(m), so as to display an image on the liquid crystal panel 10 by driving an image signal.

The gate drive circuit 30 receives the GSP signal, the OE signal, and the GCK signal output by the timing controller 40, and outputs these signals to sequentially drive, in a vertical direction, gate drive signals GOUT(1)~GOUT(n) of the gate buses GL1~GLn, so as to sequentially turn on each gate bus on the liquid crystal panel 10.

II. Working Method of an Interlaced and Progressive Format Determination Unit The interlaced and progressive format determination unit is configured to determine an input signal as a progressive image signal or an interlaced image signal including an odd-field signal and an even-field signal, to output a first control signal when the input signal is determined as the interlaced image signal, and to output a second control signal when the input signal is determined as the progressive image signal.

Specifically, the odd-field signal is an image signal including odd-line image data, the even-field signal is an image signal including even-line image data, and a frame of image in an interlaced image signal is formed by the odd-field signal and the even-field signal.

In certain embodiments, the interlaced and progressive format determination unit may be integrated in a timing control chip, or may be provided on a circuit board of a timing controller. In certain embodiments, the interlaced and progressive format determination unit may be further integrated in a master chip or on a motherboard. In certain embodiments, the interlaced and progressive format determination unit outputs a first control signal or a second control signal to the timing controller 40.

When the timing controller 40 receives the first control signal, the timing controller 40 enters an interlaced processing mode. In the interlaced processing mode, the timing controller 40 outputs, in a period of the data signal in one line, the GCK signal including two clock pulses, which includes a first clock pulse and a second clock pulse, and the OE signal including one pulse signal. In scanning the odd field, the pulse signal counteracts the second clock pulse of the two clock pulses of the GCK signal. In scanning the even field, the pulse signal counteracts the first clock pulse of the two clock pulses of the GCK signal.

When the timing controller 40 receives the second control signal, the timing controller 40 enters a progressive processing mode. In the progressive processing mode, the timing controller 40 outputs, in a period of the data signal in one line, the GCK signal including a single clock pulse, and the OE signal having a first potential.

III. Structure and Working Method of the Timing Controller

Figure 6:
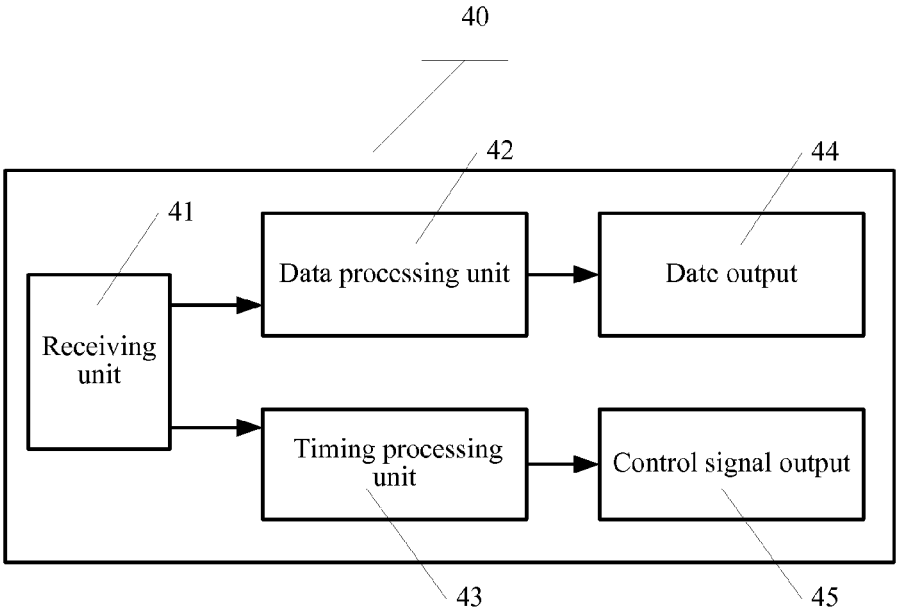
FIG. 6 is a block structural diagram of a timing controller according to one embodiment of the present invention.

FIG. 6 is a block structural diagram of a timing controller according to one embodiment of the present invention. As shown in FIG. 6, the timing controller 40 includes a receiving unit 41, an image data processing unit 42, a data output 44, a timing processing unit 43, and a control signal output 45. In certain embodiments, the timing controller 40 may be an integrated chip, or may be formed by multiple circuit components. In certain embodiments, the timing controller 40 may be formed by the integrated chip and an auxiliary circuit together.

The receiving unit 41 may receive a video data LVDS input signal including the image signal (RGB), the DE signal, the horizontal synchronization signal (Hsync), the vertical synchronization signal, and the clock signal, where the motherboard may also output a signal in another data format. One of ordinary skill in the art may learn that, according to the coordination requirement of the motherboard and the timing controller, the signals may be in any data format proper for the timing controller, and the data format applied is not intended to limit the present invention.

The image data processing unit 42 is configured to perform data processing to the received signal, which includes at least the image signal (RGB), and to provide to a data drive circuit the data signal (DV) in a data format proper for displaying of the pixels of the display panel 10. In a data signal period in one line, the image data processing unit 42 correspondingly outputs a line of image data signals. For example, when a pixel matrix of the display panel 10 is 1920*1080, 1920 units of pixel data are generated for each line, and each unit of the pixel data includes three pixel constitution units R, G, and B. The data output 44 is configured to output the generated data signal to the data drive circuit 20.

The timing processing unit 43 is configured to receive the horizontal synchronization signal (Hsync), the vertical synchronization signal (Vsync), and the clock signal, to perform timing processing to generate control signals, and to output the control signals to the gate drive circuit 30 and the data drive circuit 20. In certain embodiments, the timing processing unit 43 provides to the gate drive circuit 30 a gate control signal, which includes the OE signal, the GCK signal, and the GSP signal, and provides to the data drive circuit 20 a data control signal, which includes the SSP signal, the SCK signal, the latch signal (LS), and the SOE signal. In certain embodiments, the GSP signal is generated according to the horizontal synchronization signal (Hsync) and the vertical synchronization signal (Vsync).

When the timing controller 40 receives the first control signal, the timing controller 40 operates in the interlaced processing mode, and when receiving the second control signal, the timing controller 40 operates in the progressive processing mode.

(1) The Timing Controller Operates in Interlaced Processing Mode:

When the receiving unit 41 receives a video data input signal, which is a frame of a video signal in an interlaced format in this case, the frame of the video signal in the interlaced format includes image data having an odd-field signal and an even-field signal. The timing controller 40 performs timing processing according to the input signal, which includes the horizontal synchronization signal (Hsync), the vertical synchronization signal (Vsync) and the clock signal, and outputs a gate control signal including the OE signal, the GCK signal, and the GSP signal. In a data signal period in one line, the GCK signal includes two clock pulses, and the OE signal includes one pulse signal.

First Implementation

Figure 7:
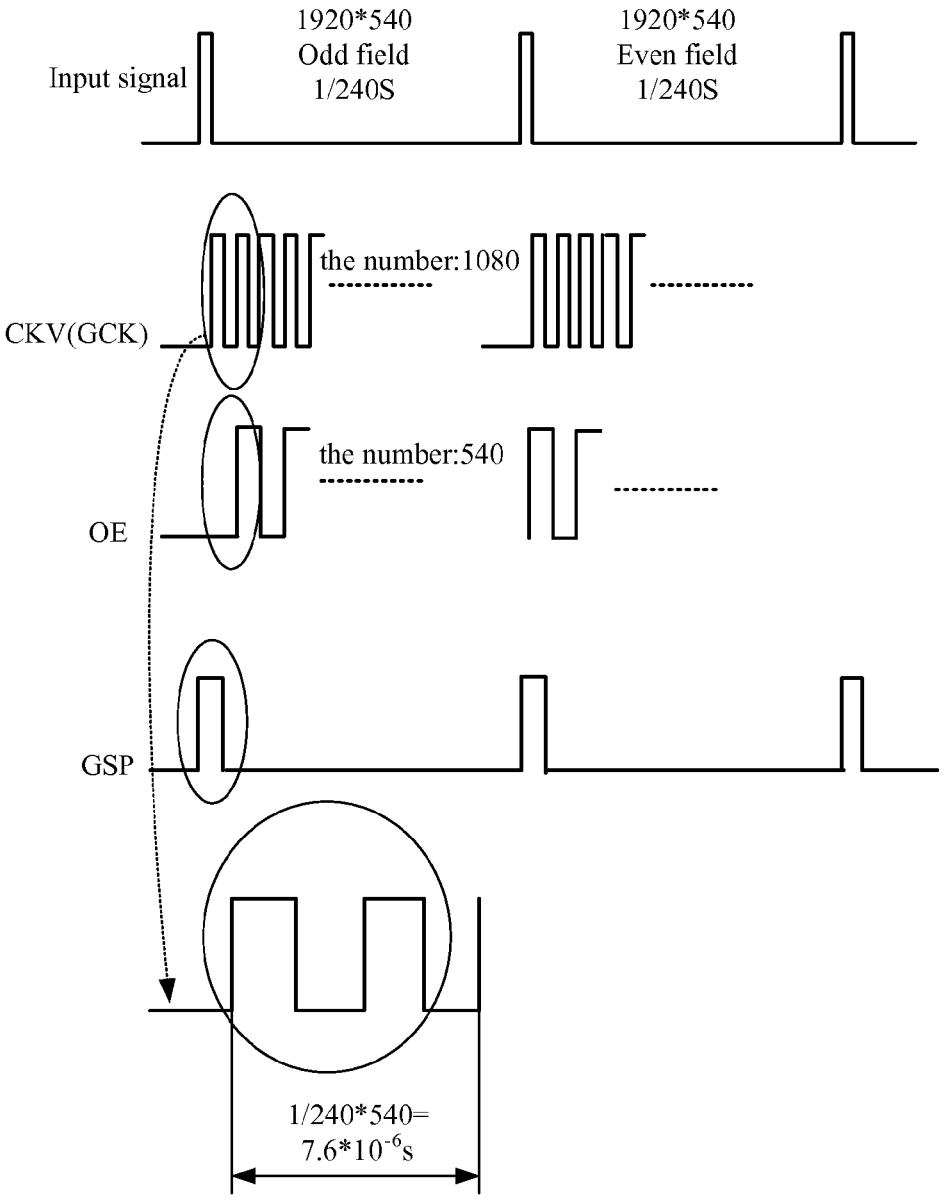
FIG. 7 is a first schematic diagram showing a timing processing unit generating a gate control signal according to one embodiment of the present invention.

FIG. 7 is a first schematic diagram showing the timing processing unit generating a gate control signal according to one embodiment of the present invention. As shown in FIG. 7, the liquid crystal panel 10 is a liquid crystal screen with a pixel solution being 1920*1080 and a refreshing frequency being 120 Hz, which is configured to receive a frame of a video signal, where the video signal is a 1920*540/240 Hz video data signal, which includes odd-field image data and even-field image data. An image data period in each line is $1/240*540=7.6*10^{-6}$ s. Within an image data sending period of $1/240*540=7.6*10^{-6}$ s in one line, the liquid crystal panel 10 generates a GCK signal, which includes two clock pulses, and an OE signal, which includes one pulse.

Specifically, the first-field signal of the input signal is video data of 1920*540/240 Hz of the odd-field, and an image signal sending period in each line is $1/240*540=7.6*10^{-6}$ s. When the timing processing unit 43 performs timing processing to output the GCK signal, within the image signal sending period of $7.6*10^{-6}$ s, two clock pulses are generated. In this way, when the 540 lines of the video data for the odd-field are input, 1080 boost pulses for the GCK signal are generated, and are correspondingly input to the gate drive circuit to generate 1080 shift output pulse signals. Moreover, within the image signal sending period in the same line, one boost pulse of the OE signal is generated and output, where the width of the boost pulse of the OE signal covers the second clock pulse of the two clock pulses of the GCK signal. In this way, 540 pulses of the OE signals are generated. The term "covering" refers to the width of the boost pulse of the OE signals being greater than the second width of the second clock pulse of the two clock pulses of the GCK signal. At a start time period of a period of the input signal of the odd-field, the timing processing unit 43 further generates the GSP signal, which is configured to start scanning for the field signal.

The second-field signal of the input signal is video data of 1920*540/240 Hz of the odd-field, and an image signal sending period in each line is $1/240*540=7.6*10^{-6}$ s. When the timing processing unit 43 performs timing processing to output the GCK signal, within the image signal sending period of $7.6*10^{-6}$ s, two clock pulses are generated. In this way, when the 540 lines of the video data for the odd-field are input, 1080 boost pulses for the GCK signal are generated, and are correspondingly input to the gate drive circuit to generate 1080 shift output pulse signals. Moreover, within the image signal sending period in the same line, one boost pulse of the OE signal is generated and output, where the width of the boost pulse of the OE signal covers the first clock pulse of the two clock pulses of the GCK signal. In this way, 540 pulses of the OE signals are generated. At a start time period of a period of the input signal of the odd-field, the timing processing unit 43 further generates the GSP signal, which is configured to start scanning for the field signal.

Second Implementation

Figure 8:
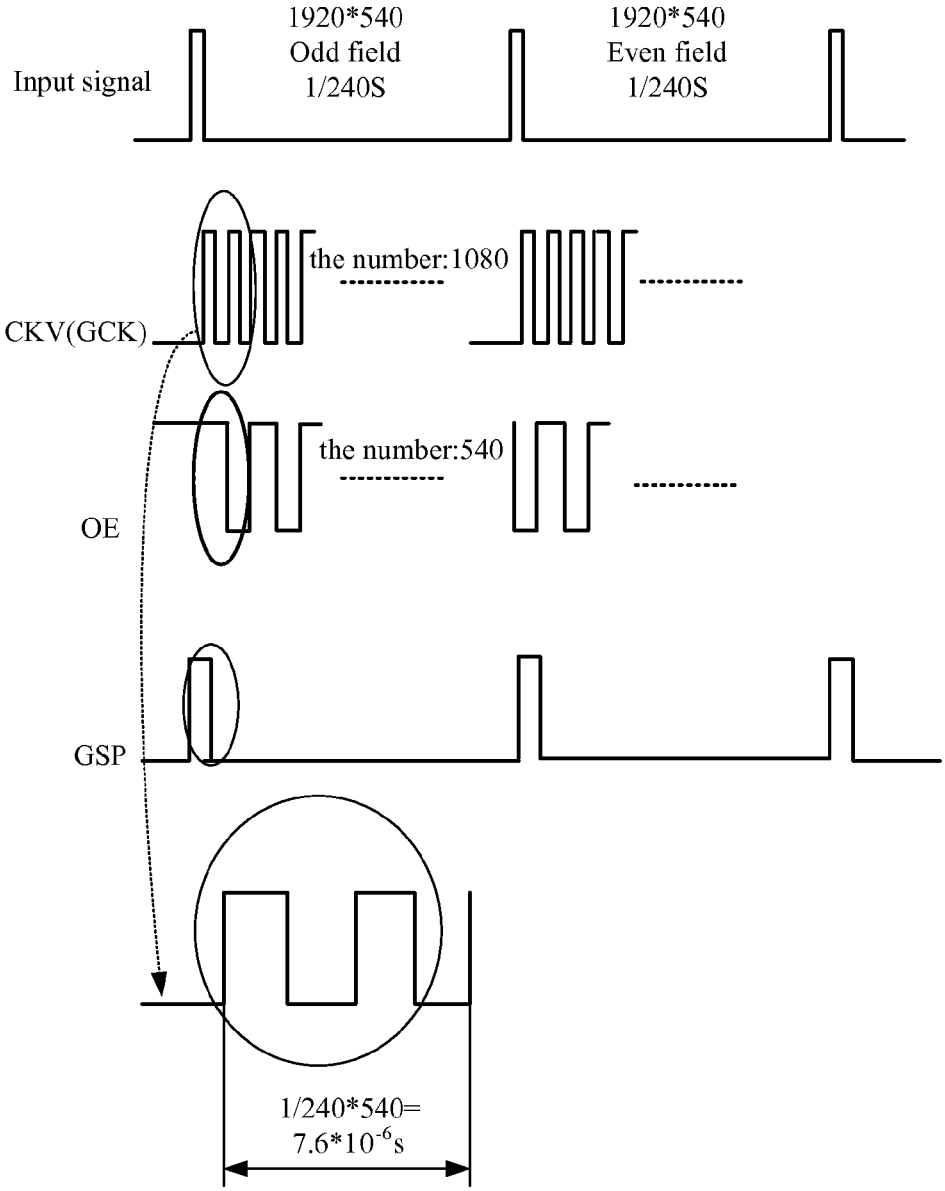
FIG. 8 is a second schematic diagram showing the timing processing unit generating a gate control signal according to one embodiment of the present invention.

FIG. 8 is a second schematic diagram showing the timing processing unit generating a gate control signal according to one embodiment of the present invention. As shown in FIG. 8, the second implementation is different from the first implementation in that, within a synchronization signal period in one line, the GCK signal includes two clock pulses, and within a corresponding synchronization signal period $1/240*540=7.6*10^{-6}$ s in the same line, the OE signal includes one pulse.

Similar to the first implementation, the first-field signal of the input signal is video data of 1920*540/240 Hz of the odd-field, and an image signal sending period in each line is $1/240*540=7.6*10^{-6}$ s. When the timing processing unit 43 performs timing processing to output the GCK signal, within the image signal sending period of $7.6*10^{-6}$ s, two clock pulses are generated. In this way, when the 540 lines of the video data for the odd-field are input, 1080 boost pulses for the GCK signal are generated, and are correspondingly input to the gate drive circuit to generate 1080 pulses of shift output signals. Moreover, within the image signal sending period in the same line, one buck pulse of the OE signal is generated and output, where the width of the buck pulse of the OE signal covers the second clock pulse of the two clock pulses of the GCK signal. In this way, 540 buck pulses of the OE signals are generated. At a start time period of a period of the input signal of the odd-field, the timing processing unit 43 further generates the GSP signal, which is configured to start scanning for the field signal.

The second-field signal of the input signal is video data of 1920*540/240 Hz of the odd-field, and an image signal sending period in each line is $1/240*540=7.6*10^{-6}$ s. When the timing processing unit 43 performs timing processing to output the GCK signal, within the image signal sending period of $7.6*10^{-6}$ s, two clock pulses are generated. In this way, when the 540 lines of the video data for the odd-field are input, 1080 boost pulses for the GCK signal are generated, and are correspondingly input to the gate drive circuit to generate 1080 pulses of shift output signals. Moreover, within the image signal sending period in the same line, one buck pulse of the OE signal is generated and output, where the width of the buck pulse of the OE signal covers the first clock pulse of the two clock pulses of the GCK signal. In this way, 540 buck pulses of the OE signals are generated. At a start time period of a period of the input signal of the odd-field, the timing processing unit 43 further generates the GSP signal, which is configured to start scanning for the field signal.

(2) The Timing Controller Operates in Progressive Processing Mode:

When the timing controller 40 receives the second control signal, the timing controller 40 operates in the progressive processing mode. In the progressive processing mode, the timing controller 40 performs timing processing to the received video data in the progressive format, and generates a gate control signal, which includes the OE signal, the GCK signal, and the GSP signal.

Figure 15:
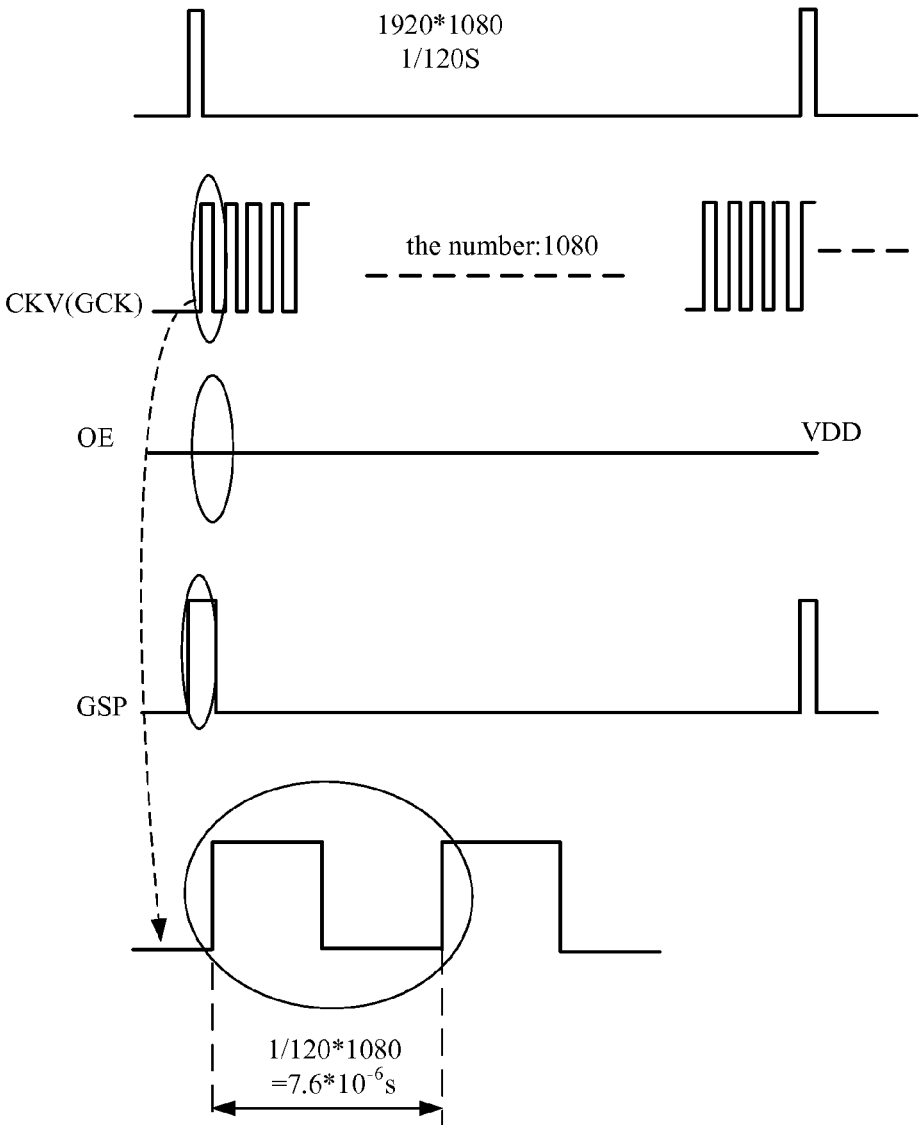
FIG. 15 is a third schematic diagram showing the timing processing unit generating a gate control signal according to one embodiment of the present invention.

FIG. 15 is a third schematic diagram showing the timing processing unit generating a gate control signal according to one embodiment of the present invention. As shown in FIG. 15, the received input signal includes a video data signal of 1920*1080/120 Hz in a progressive format. Within a data synchronization period 1/120*1080=7.6*$10^{-6}$ s in each line, a GCK signal is correspondingly generated, and an OE signal having a first potential is generated, where the first potential may be a low potential or may be a high potential.

IV. Structure and Working Method of the Gate Drive Circuit

The gate drive circuit 30 receives the gate control signal output by the timing controller 40, which includes the OE signal, the GCK signal and the GSP signal. In scanning the odd field, at a first time period corresponding to the first clock pulse of the two clock pulses of the GCK signal, the gate drive circuit 30 outputs the gate drive signal in a high potential to drive one of odd-line gate buses, and at a second time period corresponding to the second clock pulse of the two clock pulses, the gate drive circuit 30 outputs the gate drive signal in a low potential to drive one of even-line gate buses. In scanning the even field, at the first time period, the gate drive circuit 30 outputs the gate drive signal in the low potential to drive one of the odd-line gate buses, and at the second time period, the gate drive circuit 30 outputs the gate drive signal in the high potential to drive one of the even-line gate buses.

Figure 20:
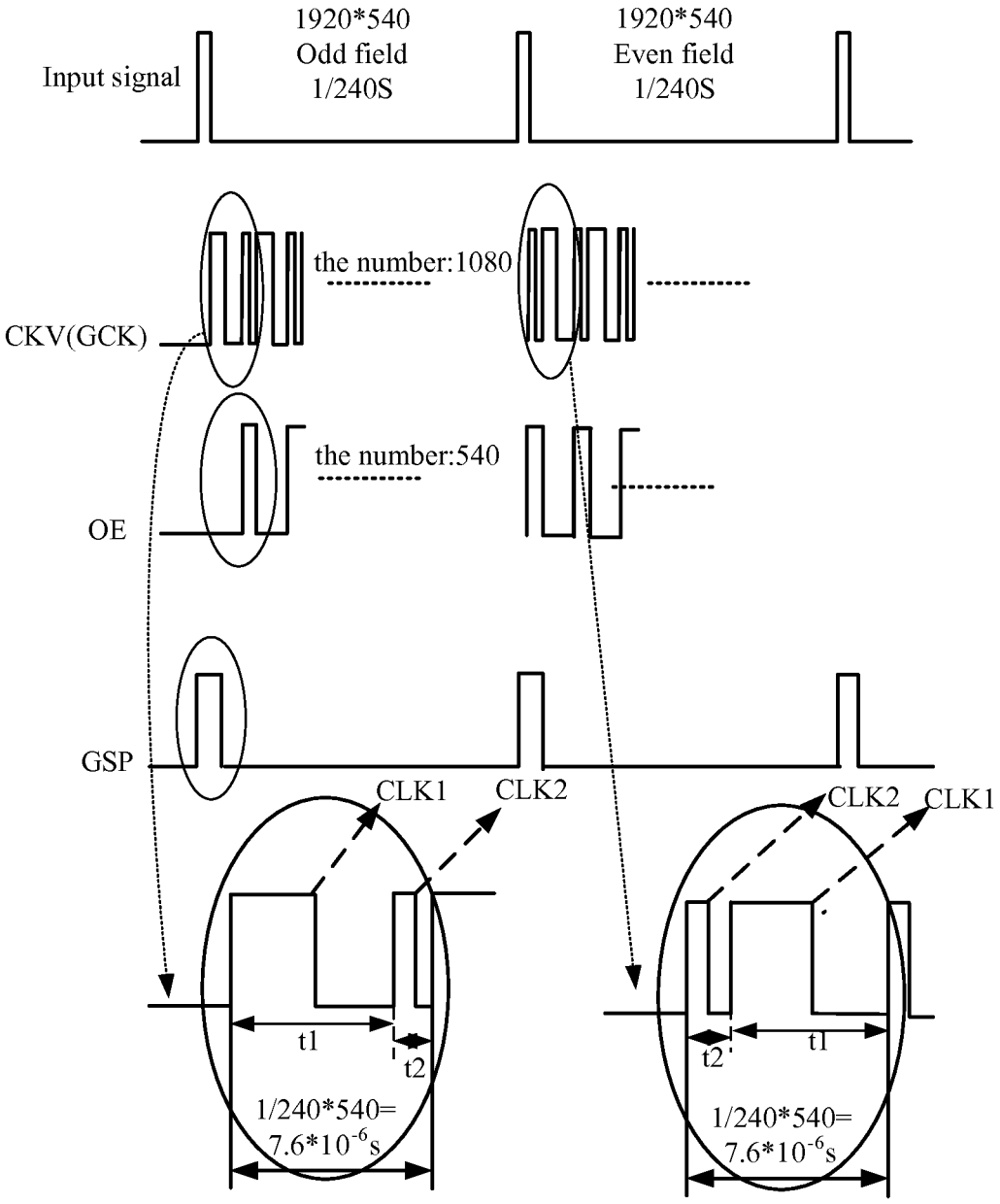
FIG. 20 is a first schematic diagram showing the timing processing unit generating a gate control signal according to one embodiment of the present invention.

Each of the first and second time periods corresponding to the two clock pulses is a clock pulse period, and is formed by a boost pulse and a buck pulse, as shown in FIG. 20, where t1 and t2 in the figure respectively indicate a time period corresponding to one clock pulse.

Further, in scanning the odd field, the pulse signal counteracts the second clock pulse of the two clock pulses, such that the gate drive signal to drive the even-line gate buses is in the low potential at the second time point. In scanning the even field, the pulse signal counteracts the first clock pulse of the two clock pulses, such that the gate drive signal to drive the odd-line gate buses is in the low potential at the first time point.

The term "counteracting" refers to an operation that a shift output signal in a high potential, which is generated by the clock pulse, and the boost pulse in a corresponding timing undergo a logic circuit process in the gate drive circuit, thus outputting a gate drive signal in the low potential.

Figure 16:
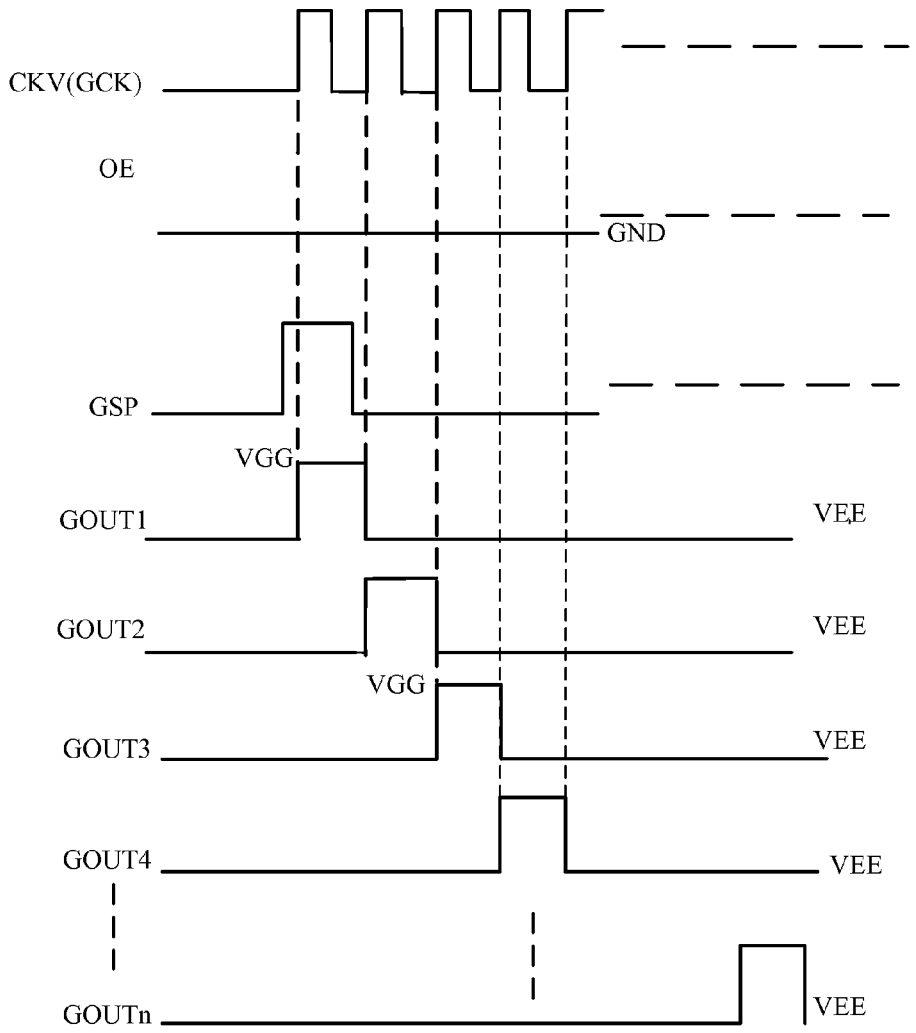
FIG. 16 is a first schematic diagram showing signal processing by a gate drive circuit for a progressive signal according to one embodiment of the present invention.
Figure 17:
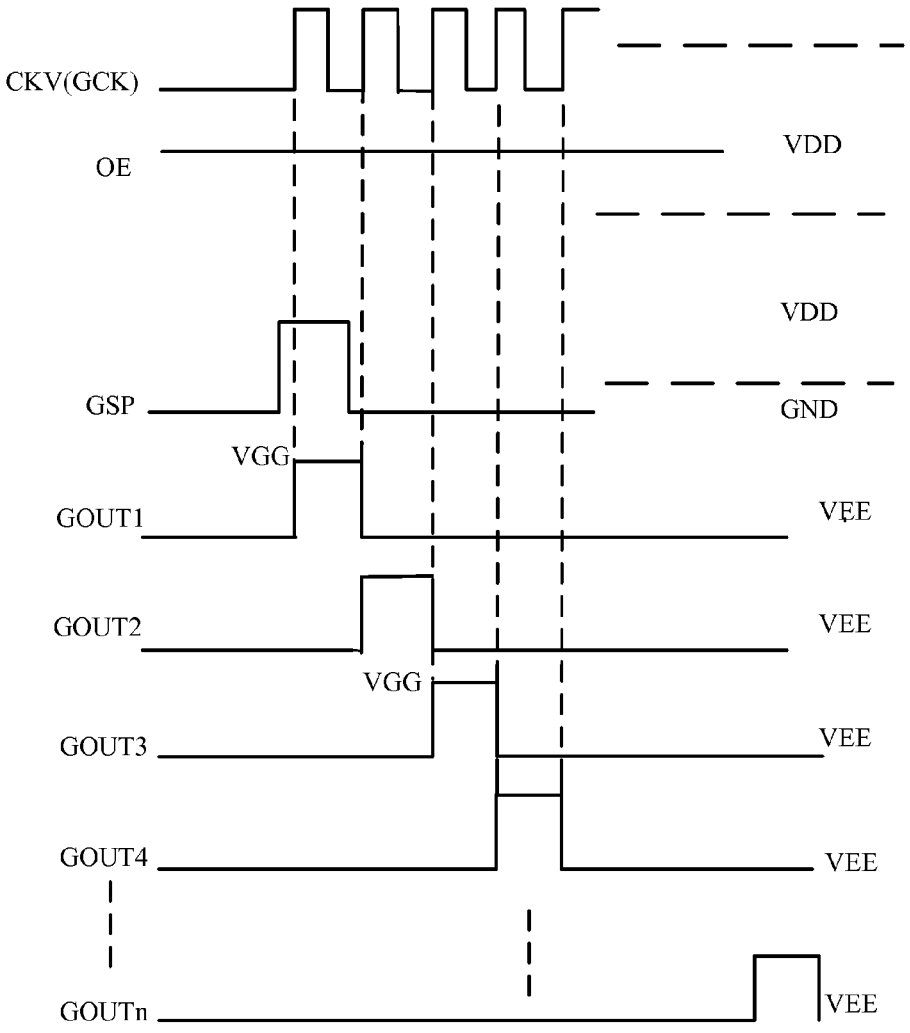
FIG. 17 is a second schematic diagram showing signal processing by the gate drive circuit for a progressive signal according to one embodiment of the present invention.

Specifically, in one embodiment, when an interlaced signal including an odd-field signal and an even-field signal is received, the interlaced signal is converted into a progressive signal, and then scanned and displaced in a progressive scanning manner. Referring to FIG. 15, during progressive scanning, a gate bus start signal is generated correspondingly to each clock pulse signal of the GCK signal output by the timing controller. In a 1080-line liquid crystal panel, 1080 clock pulses are required, and the OE signal is output in a high potential (high potential being effective, where the gate drive circuit receives the OE to perform an AND gate logic operation with a shift output signal directly) or a low potential (low potential being effective, where the gate drive circuit receives the OE to perform an AND gate logic operation with a shift output signal directly). Further referring to FIG. 16 and FIG. 17, where FIG. 16 shows that the OE signal is effective at the low potential, and FIG. 17 shows that the OE signal is effective at the high potential. In a process of sequentially scanning each line of the gate buses, at the first time period corresponding to the first clock pulse, the gate drive signal on the corresponding gate bus in the first line generates a high potential pulse, and the high potential pulse drives the gate bus in the first line to turn on, while the gate drive signals on other gate buses are all in the low potential. At the second time period corresponding to the second clock pulse, the gate drive signal on the corresponding gate bus in the second line generates a high potential pulse, and the high potential pulse drives the gate bus in the second line to turn on, while the gate drive signals on other gate buses are all in the low potential. The following procedures of the process may be deduced by analogy. At the n-th time period corresponding to the n-th clock pulse, the gate drive signal on the corresponding gate bus in the n-th line generates a high potential pulse, and the high potential pulse drives the gate bus in the n-th line to turn on, while the gate drive signals on other gate buses are all in the low potential.

In certain embodiments of the present invention, in scanning the odd field, the pulse signal of the OE signal counteracts the second clock pulse of the two clock pulses of the GCK signal, such that the gate drive signal to drive the even-line gate buses is in the low potential at the second time point. In this way, when the gate drive signal drives the odd-line gate buses at the first time period corresponding to the first clock pulse, a high potential pulse is generated, and a corresponding odd-line gate bus is driven to turn on. When the gate drive signal drives the even-line gate buses at the second time period corresponding to the second clock pulse, a low potential pulse is generated, and a corresponding even-line gate bus is turned off. Therefore, in a process of sequentially scanning each line of the gate buses, at the first time period corresponding to the first clock pulse, the gate drive signal on the corresponding gate bus in the first line generates a high potential pulse, and the high potential pulse drives the gate bus in the first line to turn on, while the gate drive signals on other gate buses are all in the low potential. At the second time period corresponding to the second clock pulse, the gate drive signal on the corresponding gate bus in the second line generates a low potential pulse, and the low potential pulse turns off the gate bus in the second line, while the gate drive signals on other gate buses are all in the low potential. The following procedures of the process may be deduced by analogy. At the (n−1)th time period corresponding to the (n−1)th (which is an odd number) clock pulse, the gate drive signal on the corresponding gate bus in the (n−1)th line generates a high potential pulse, and the high potential pulse drives the gate bus in the (n−1)th line to turn on, while the gate drive signals on other gate buses are all at the low potential. At the n-th time period corresponding to the n-th (which is an even number) clock pulse, the gate drive signal on the corresponding gate bus in the n-th line generates a low potential pulse, and the low potential pulse turns off the gate bus in the n-th line, while the gate drive signals on other gate buses are all in the low potential.

In scanning the even field, the pulse signal counteracts the first clock pulse of the two clock pulses, such that the gate drive signal to drive the odd-line gate buses is in the low potential at the first time point. In this way, when the gate drive signal drives the odd-line gate buses at the first time period corresponding to the first clock pulse, a low potential pulse is generated, and a corresponding odd-line gate bus is turned off. When the gate drive signal drives the even-line gate buses at the second time period corresponding to the second clock pulse, a high potential pulse is generated, and a corresponding even-line gate bus is driven to turn on. Therefore, in a process of sequentially scanning each line of the gate buses, at the first time period corresponding to the first clock pulse, the gate drive signal on the corresponding gate bus in the first line generates a low potential pulse, and the low potential pulse turns off the gate bus in the first line, while the gate drive signals on other gate buses are all in the low potential. At the second time period corresponding to the second clock pulse, the gate drive signal on the corresponding gate bus in the second line generates a high potential pulse, and the high potential pulse drives the gate bus in the second line to turn on, while the gate drive signals on other gate buses are all in the low potential. The following procedures of the process may be deduced by analogy. At the (n−1)th time period corresponding to the (n−1)th (which is an odd number) clock pulse, the gate drive signal on the corresponding gate bus in the (n−1)th line generates a low potential pulse, and the low potential pulse turns off the gate bus in the (n−1)th line, while the gate drive signals on other gate buses are all at the low potential. At the n-th time period corresponding to the n-th (which is an even number) clock pulse, the gate drive signal on the corresponding gate bus in the n-th line generates a high potential pulse, and the high potential pulse drives the gate bus in the n-th line to turn on, while the gate drive signals on other gate buses are all in the low potential.

A first embodiment of the gate drive circuit 30 is provided as follows.

(1) First Embodiment of the Gate Drive Circuit Operating in an Interlaced Mode

Figure 9:
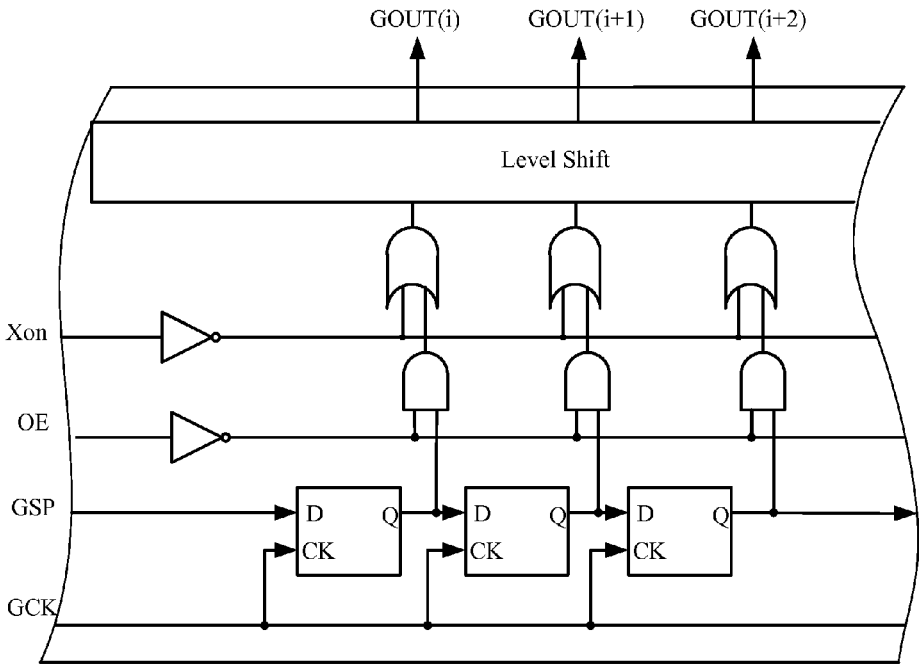
FIG. 9 is a first block structural diagram of a gate drive circuit according to one embodiment of the present invention.

FIG. 9 is a first block structural diagram of a gate drive circuit according to one embodiment of the present invention. As shown in FIG. 9, the gate drive circuit 30 includes a shift register and an AND gate circuit. The shift register is configured to receive the GCK signal as a shift clock signal, to receive the GSP signal as a shift trigger signal, and to generate a shift output signal. The GSP signal is connected to the end D of the shift register, and the GCK is connected to the end CK of the shift register. An output end Q of the shift register is connected to a first input end of the AND gate circuit, and the OE signal is connected to the second input end of the AND gate circuit with an inverter. The AND gate circuit has a first input end configured to receive the shift output signal from the shift register, and a second input end configured to receive a phase inversion signal of the OE signal. The AND gate circuit is configured to perform an AND logic process on the shift output signal and the phase inversion signal to generate an output signal as the gate drive signal.

Figure 10:
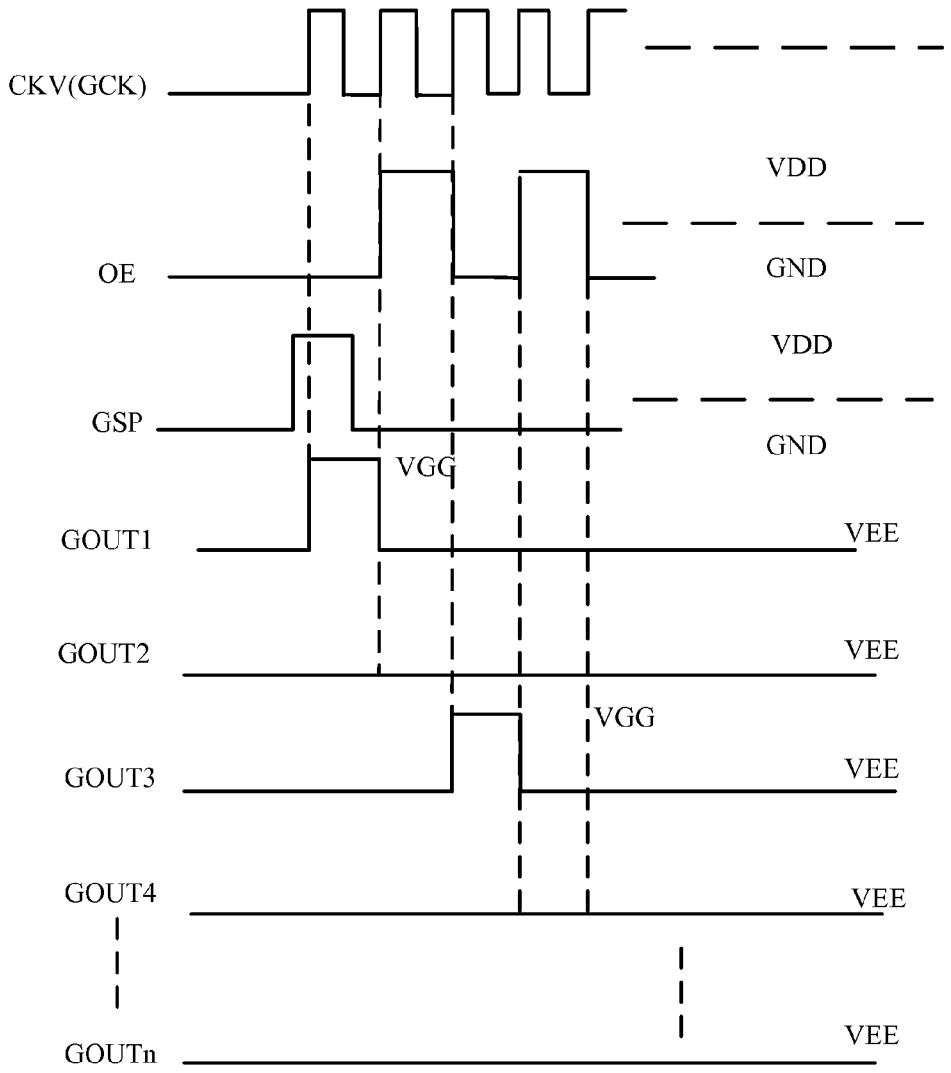
FIG. 10 is a first schematic diagram showing signal processing by a gate drive circuit for an odd-field signal according to one embodiment of the present invention.

Specifically, FIG. 10 is a first schematic diagram showing signal processing by a gate drive circuit for an odd-field signal according to one embodiment of the present invention. As shown in FIG. 10, and with reference to FIG. 7 and FIG. 9, in a process of scanning the odd field, within an image data period in one line, the boost pulse of the pulse signal of the OE signal counteracts the second clock pulse of the two clock pulses of the GCK signal.

Further referring to FIGS. 9 and 10, the shift register processes with the first clock pulse of the GCK signal and the GSP signal to output a first shift output signal in the high potential are shown. Correspondingly, the OE signal is in the low potential, such that the low potential OE signal is converted by the inverter into a phase inversion signal in the high potential. The high potential shift output signal and the high potential phase inversion signal undergo logic operation by the AND gate circuit to output GOUT(1) in the high potential, which correspondingly drives the first gate bus to turn on, and writes the image data of the first line therein. Next, a first boost pulse of the OE signal, which is in the high potential, is converted to a low potential pulse of the phase inversion signal by the inverter through phase inversion processing. Correspondingly, the second clock signal of the GCK signal outputs a second shift output signal in the high potential. The low potential phase inversion signal obtained through phase inversion and the high potential shift output signal undergo logic operation by the AND gate circuit to output GOUT(2) in the low potential, which correspondingly skips the second gate bus by turning it off. In other words, the first boost pulse of the OE signal in the high potential counteracts the second high potential shift output signal in the high potential, which is correspondingly generated according to the second clock pulse of the GCK signal, so as to output the low potential GOUT(2). The following procedures of the process may be deduced by analogy. A high potential GOUT(3) is output to turn on the third gate bus and write the image data of the second line therein, and a low potential GOUT(4) is output to skip the fourth gate bus. Accordingly, the output gate drive signal GOUT(n) outputs a high potential in an odd line, and outputs a low potential in an even line. Each of the GOUT signals corresponding to the odd-line gate buses is in a high potential to turn on the corresponding odd-line gate bus and write the image data of one line therein. Each of the GOUT signals corresponding to the even-line gate buses is in a low potential to turn off the corresponding even-line gate bus, and image data in the previous field therein is maintained.

In the first implementation of the Embodiment 1, in scanning the odd field, in an output period for providing image data of each line to the liquid crystal panel, a high potential GOUT signal is output to each of the odd lines, and a low potential GOUT signal is output to each of the even lines. In this way, a high potential GOUT signal is output in scanning the odd lines to turn on the corresponding odd-line gate bus and correspondingly write a line of data signals therein. A low potential GOUT signal is output in scanning the even lines to turn off the corresponding even-line gate bus is turned off, and the data signal in the previous field therein is maintained. Thus, the odd-line image is refreshed and displayed by the odd-field data signal.

Figure 11:
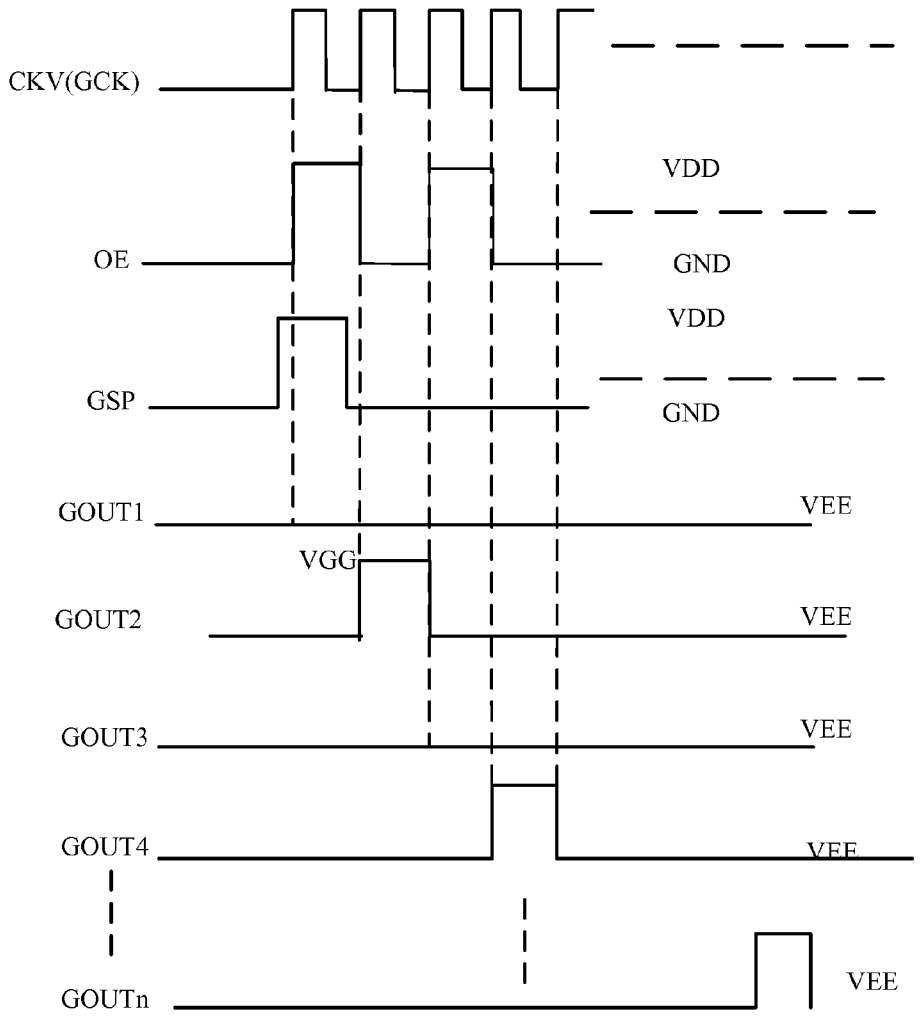
FIG. 11 is a first schematic diagram showing signal processing by the gate drive circuit for an even-field signal according to one embodiment of the present invention.

FIG. 11 is a first schematic diagram showing signal processing by the gate drive circuit for an even-field signal according to one embodiment of the present invention. As shown in FIG. 11, and with reference to FIG. 7 and FIG. 9, in a process of scanning the even field, within a synchronization signal pulse period in each line, the boost pulse of the OE signal, which is in the first potential, counteracts the first clock pulse of the two clock pulses of the GCK signal.

Further, as shown in FIG. 11, the shift register processes with the first clock pulse of the GCK signal and the GSP signal to output a first shift output signal in the high potential. Correspondingly, the OE signal is in the high potential, such that the high potential OE signal is converted by the inverter into a phase inversion signal in the low potential. The high potential shift output signal and the low potential phase inversion signal undergo logic operation by the AND gate circuit to output GOUT(1) in the low potential, which correspondingly skips the first gate bus by turning it off. Next, the second clock signal of the GCK signal outputs a second shift output signal in the high potential. Correspondingly, the OE signal, which is in the low potential, is converted to a high potential pulse of the phase inversion signal by the inverter through phase inversion processing. The high potential shift output signal and the high potential phase inversion signal obtained through phase inversion undergo logic operation by the AND gate circuit to output GOUT(2) in the high potential, which correspondingly drives the second gate bus to turn on, and writes the image data of the first line therein. The following procedures of the process may be deduced by analogy. A low potential GOUT(3) is output to skip the third gate bus, and a low potential GOUT(4) is output to turn on the fourth gate bus and write the image data of the second line therein. Accordingly, the output gate drive signal GOUT outputs a low potential in an odd line, and outputs a high potential in an even line. Each of the GOUT signals corresponding to the odd-line gate buses is in a low potential to turn off the corresponding odd-line gate bus, and image data in the previous field therein is maintained. Each of the GOUT signals corresponding to the even-line gate buses is in a high potential to turn on the corresponding even-line gate bus and write the image data of one line therein.

In the first implementation of the Embodiment 1, in scanning the even field, in an output period for providing image data of each line to the liquid crystal panel, a high potential GOUT signal is output to each of the even lines, and a low potential GOUT signal is output to each of the odd lines. In this way, a high potential GOUT signal is output in scanning the even lines to turn on the corresponding even-line gate bus and correspondingly write a line of data signals therein. A low potential GOUT signal is output in scanning the odd lines to turn off the corresponding odd-line gate bus is turned off, and the data signal in the previous field therein is maintained. Thus, the even-line image is refreshed and displayed by the odd-field data signal.

(2) First Embodiment of the Gate Drive Circuit Operating in a Progressive Mode

FIG. 16 is a first schematic diagram showing signal processing by the gate drive circuit for a progressive signal according to one embodiment of the present invention. As shown in FIG. 16, and with reference to FIG. 9 and FIG. 15, in a progressively scanning mode, the OE signal maintains in the low potential in a data signal period in each line, and is then converted into a high potential phase inversion signal by the inverter as shown in FIG. 9. The high potential phase inversion signal and the high potential shift output signal generated by each clock pulse undergo an AND gate logic operation to output a gate drive signal GOUT(n) in the high potential. In this way, in the progressive scanning mode of the gate drive circuit, a high potential gate drive signal GOUT(n) is progressively output to drive each of the gate buses sequentially and progressively, thereby writing image data into each line. As shown in FIG. 16, the output drive signals GOUT(1) to GOUT(n), which are all in the high potential, are output progressively and sequentially. Thus, the image of all lines are refreshed and displayed progressively by the progressive signal.

In the first implementation of the Embodiment 1, by receiving the odd-field signal, the odd-line image can be refreshed and displayed, and by receiving the even-field signal, the even-line image can be refreshed and displayed. By receiving the progressive image signal, the image can be refreshed and displayed progressively. In this way, the display device implemented by the technical solution of the embodiment can achieve compatible progressive and interlaced scanning and displaying, thereby saving the storage and a periphery auxiliary circuit required in a format converter in the conventional device.

Figure 12:
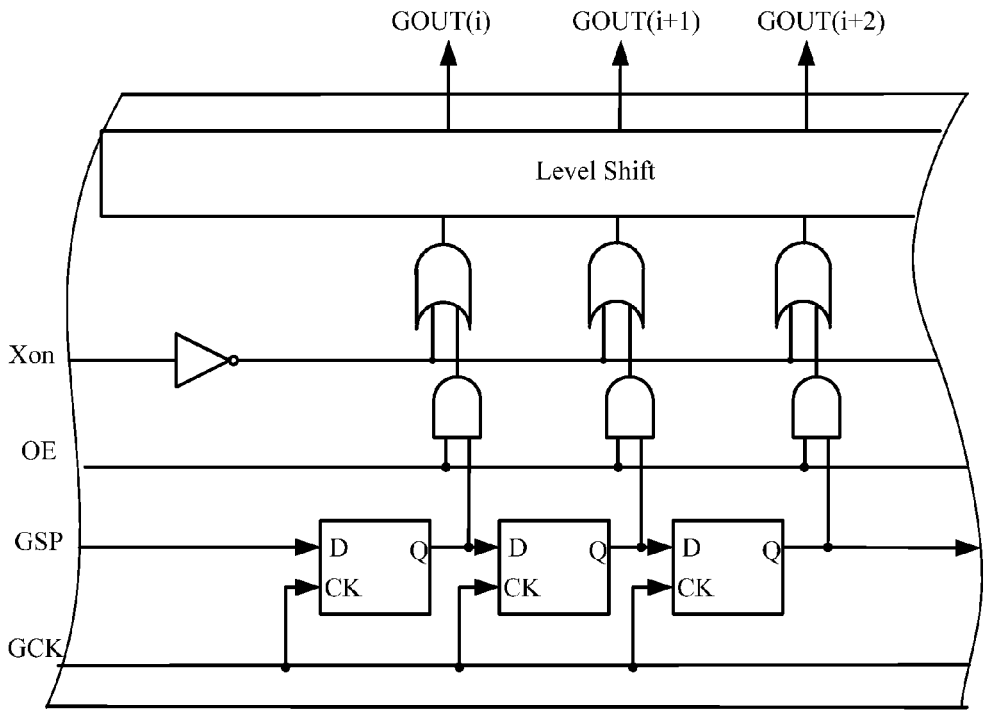
FIG. 12 is a second block structural diagram of a gate drive circuit of the present invention.

A second embodiment of the gate drive circuit 30 is provided as follows:

FIG. 12 is a second block structural diagram of a gate drive circuit according to one embodiment of the present invention. As shown in FIG. 12, the gate drive circuit 30 includes a shift register and an AND gate circuit. The shift register is configured to receive the GCK signal as a shift clock signal, to receive the GSP signal as a shift trigger signal, and to generate a shift output signal. The GSP signal is connected to the end D of the shift register, and the GCK is connected to the end CK of the shift register. An output end Q of the shift register is connected to a first input end of the AND gate circuit, and the OE signal is connected to the second input end of the AND gate circuit. The AND gate circuit has a first input end configured to receive the shift output signal from the shift register, and a second input end configured to receive the OE signal. The AND gate circuit is configured to perform an AND logic process on the shift output signal and the OE signal to generate an output signal as the gate drive signal.

(3) Second Embodiment of the Gate Drive Circuit Operating in an Interlaced Mode

Figure 13:
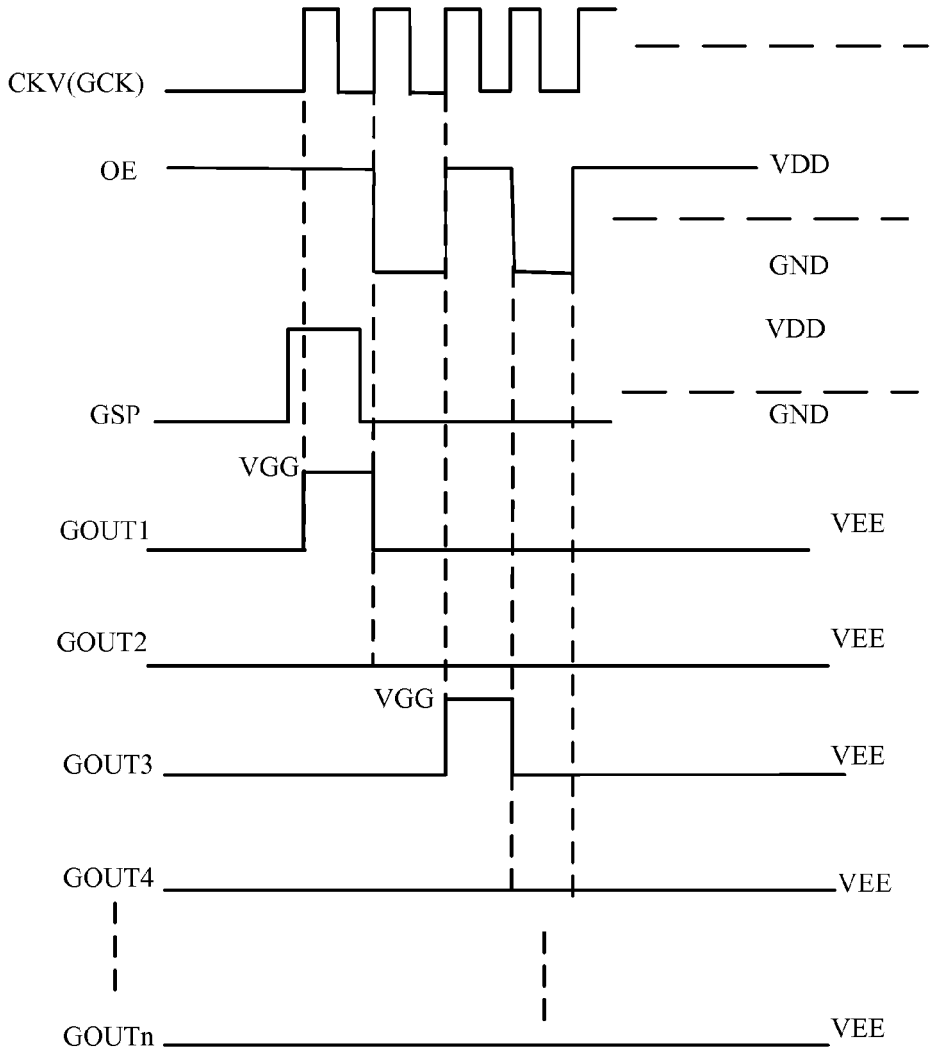
FIG. 13 is a second schematic diagram showing signal processing by a gate drive circuit for an odd-field signal according to one embodiment of the present invention.

Specifically, FIG. 13 is a second schematic diagram showing signal processing by a gate drive circuit for an odd-field signal according to one embodiment of the present invention. As shown in FIG. 13, and with reference to FIG. 8 and FIG. 10, in a process of scanning the odd field, within an image data period in one line, the buck pulse of the pulse signal of the OE signal counteracts the second clock pulse of the two clock pulses of the GCK signal.

Further, as shown in FIG. 13, the shift register processes with the first clock pulse of the GCK signal and the GSP signal to output a first shift output signal in the high potential. Correspondingly, the OE signal is in the high potential. The high potential shift output signal and the high potential OE signal undergo logic operation by the AND gate circuit to output GOUT(1) in the high potential, which correspondingly drives the first gate bus to turn on, and writes the image data of the first line therein. Next, a first buck pulse of the OE signal is in the low potential. Correspondingly, the second clock signal of the GCK signal outputs a second shift output signal in the high potential. The low potential phase inversion signal obtained through phase inversion and the high potential shift output signal undergo logic operation by the AND gate circuit to output GOUT(2) in the low potential, which correspondingly skips the second gate bus by turning it off, and the image data in the previous field therein is maintained. The following procedures of the process may be deduced by analogy. A high potential GOUT(3) is output to turn on the third gate bus and write the image data of the second line therein, and a low potential GOUT(4) is output to skip the fourth gate bus. Accordingly, the output gate drive signal GOUT(n) outputs a high potential in an odd line, and outputs a low potential in an even line. Each of the GOUT signals corresponding to the odd-line gate buses is in a high potential to turn on the corresponding odd-line gate bus and write the image data of one line therein. Each of the GOUT signals corresponding to the even-line gate buses is in a low potential to turn off the corresponding even-line gate bus, and image data in the previous field therein is maintained.

In the second implementation of the Embodiment 1, in scanning the odd field, in an image data period in each line, a high potential GOUT signal is output to each of the odd lines, and a low potential GOUT signal is output to each of the even lines. In this way, a high potential GOUT signal is output in scanning the odd lines to turn on the corresponding odd-line gate bus and correspondingly write a line of data signals therein. A low potential GOUT signal is output in scanning the even lines to turn off the corresponding even-line gate bus is turned off, and the data signal in the previous field therein is maintained. Thus, the odd-line image is refreshed and displayed by the odd-field data signal.

Figure 14:
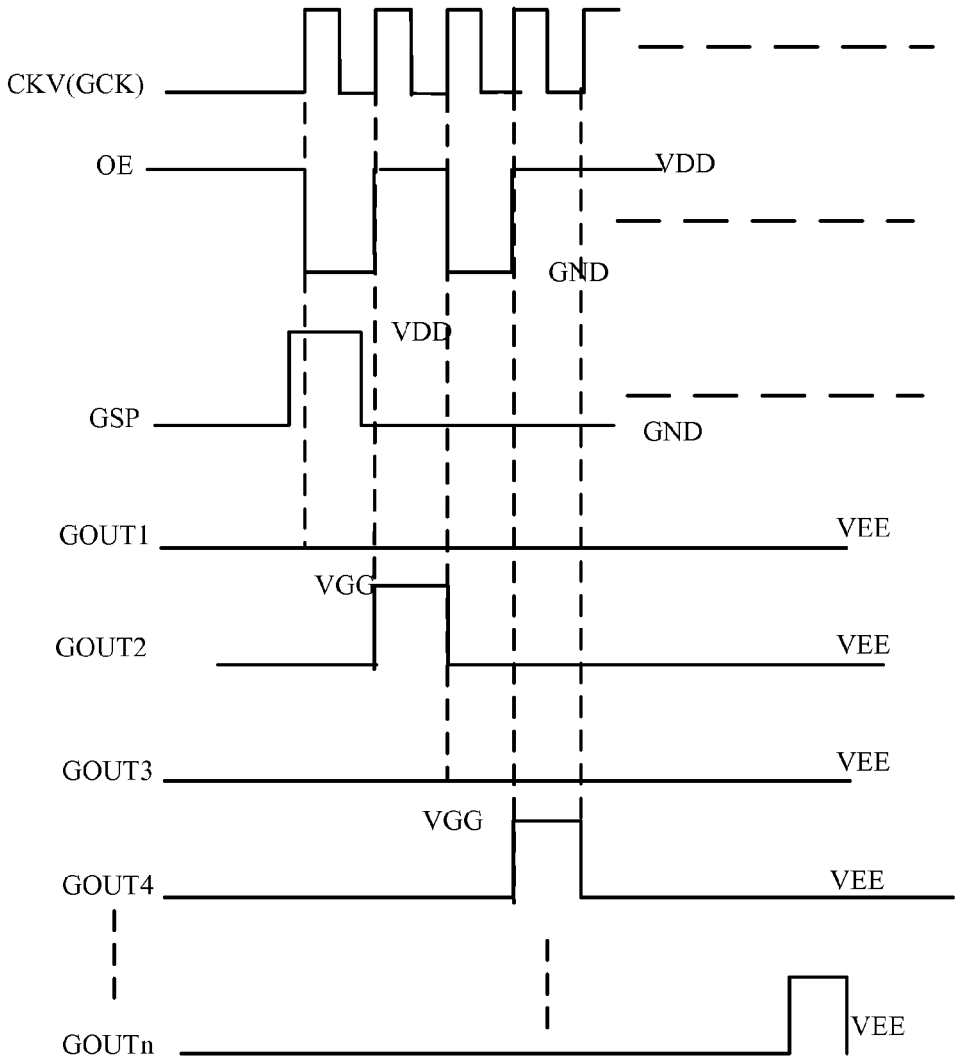
FIG. 14 is a second schematic diagram showing signal processing by the gate drive circuit for an even-field signal according to one embodiment of the present invention.

FIG. 14 is a second schematic diagram showing signal processing by the gate drive circuit for an even-field signal according to one embodiment of the present invention. As shown in FIG. 14, and with reference to FIG. 8 and FIG. 10, in a process of scanning the even field, within an image data sending period in one line, the buck pulse of the OE signal, which is in the low potential, counteracts the first clock pulse of the two clock pulses of the GCK signal.

Further, as shown in FIG. 14, the shift register processes with the first clock pulse of the GCK signal and the GSP signal to output a first shift output signal in the high potential. Correspondingly, the buck pulse of the OE signal is in the low potential. The high potential shift output signal and the low potential OE signal undergo logic operation by the AND gate circuit to output GOUT(1) in the low potential, which correspondingly skips the first gate bus by turning it off. Next, the second clock signal of the GCK signal outputs a second shift output signal in the high potential. Correspondingly, the OE signal is in the high potential. The high potential shift output signal and the high potential OE signal obtained through phase inversion undergo logic operation by the AND gate circuit to output GOUT(2) in the high potential, which correspondingly drives the second gate bus to turn on, and writes the image data of the first line therein. The following procedures of the process may be deduced by analogy. A low potential GOUT (3) is output to skip the third gate bus, and a low potential GOUT(4) is output to turn on the fourth gate bus and write the image data of the second line therein. Accordingly, the output gate drive signal GOUT outputs a low potential in an odd line, and outputs a high potential in an even line. Each of the GOUT signals corresponding to the odd-line gate buses is in a low potential to turn off the corresponding odd-line gate bus, and image data in the previous field therein is maintained. Each of the GOUT signals corresponding to the even-line gate buses is in a high potential to turn on the corresponding even-line gate bus and write the image data of one line therein.

In the second implementation of the Embodiment 1, in scanning the even field, in a data period in each line, a high potential GOUT signal is output to each of the even lines, and a low potential GOUT signal is output to each of the odd lines. In this way, a high potential GOUT signal is output in scanning the even lines to turn on the corresponding even-line gate bus and correspondingly write a line of data signals therein. A low potential GOUT signal is output in scanning the odd lines to turn off the corresponding odd-line gate bus is turned off, and the data signal in the previous field therein is maintained. Thus, the even-line image is refreshed and displayed by the odd-field data signal.

(4) Second Embodiment of the Gate Drive Circuit Operating in a Progressive Mode

FIG. 17 is a second schematic diagram showing signal processing by the gate drive circuit in a progressive mode according to one embodiment of the present invention. As shown in FIG. 17, and with reference to FIG. 12 and FIG. 15, in a progressively scanning procedure, a gate OE signal maintains in the high potential in an image data period in each line. The high potential GOE signal and the high potential shift output signal output by the shift register undergo an AND gate logic operation to output a gate drive signal GOUT(n) in the high potential. In this way, in the progressive scanning mode of the gate drive circuit, a high potential gate drive signal GOUT(n) is progressively output to drive each of the gate buses sequentially and progressively, thereby writing image data into each line. As shown in FIG. 17, the output drive signals GOUT(1) to GOUT(n), which are all in the high potential, are output progressively and sequentially. Thus, the image of all lines are refreshed and displayed progressively by the progressive signal.

In the second implementation of the Embodiment 1 by receiving the odd-field signal, the odd-line image can be refreshed and displayed, and by receiving the even-field signal, the even-line image can be refreshed and displayed. By receiving the progressive image signal, the image can be refreshed and displayed progressively. In this way, the display device implemented by the technical solution of the embodiment can achieve compatible progressive and interlaced scanning and displaying.

In this embodiment, an image displaying method is further provided, which may be applied to a display device driven by a gate drive signal and a data drive signal.

S10: Determine an input signal as an interlaced signal or a progressive signal. When the input signal is an interlaced signal, execute Step S20. When the input signal is a progressive signal, execute Step S30.

Figure 18:
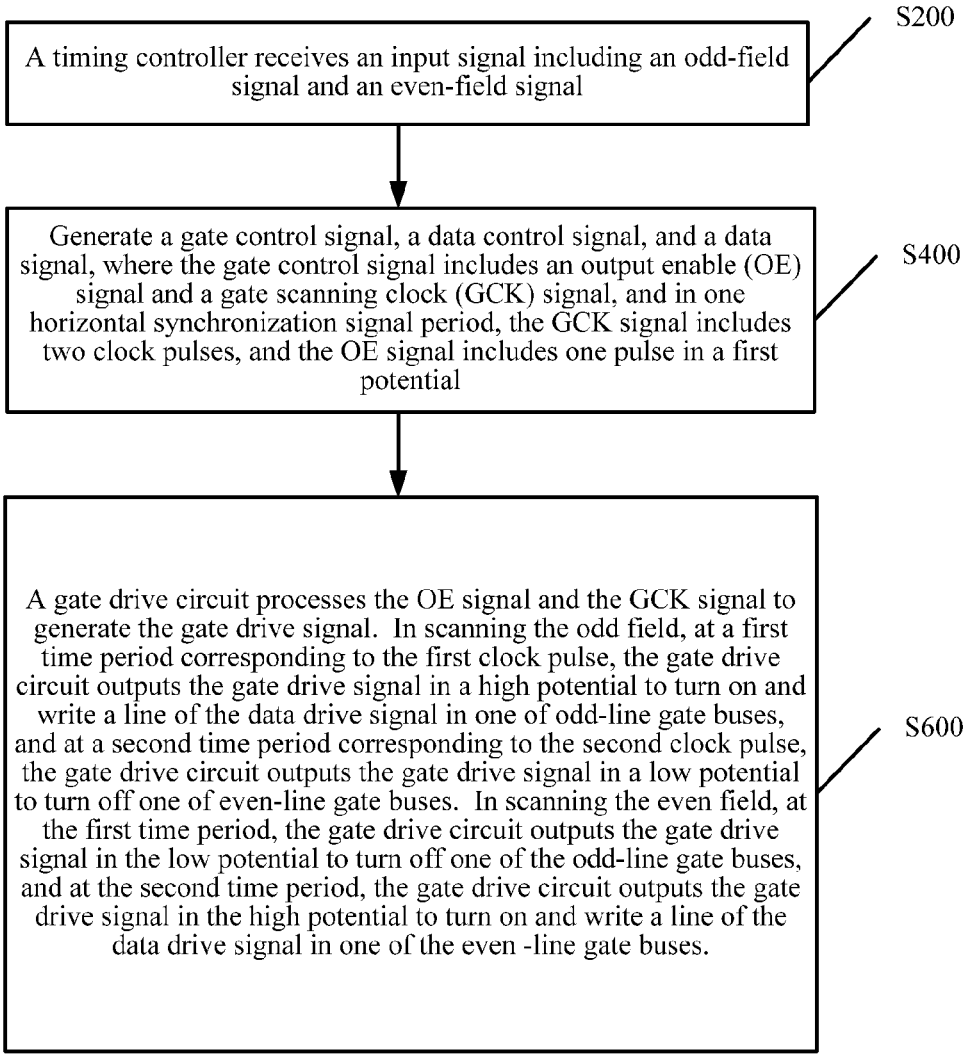
FIG. 18 shows an image display method of an interlaced signal according to one embodiment of the present invention.

FIG. 18 shows an image display method of an interlaced signal according to one embodiment of the present invention. As shown in FIG. 18, Step S20 includes:

S200: A timing controller receives an input signal, which includes an odd-field signal and an even-field signal, where the input signal includes an image signal, a horizontal synchronization signal, a vertical synchronization signal, a DE signal, and a clock signal.

S400: Generate a gate control signal, a data control signal, and a data signal, where the gate control signal includes an OE signal and a GCK signal, and in one horizontal synchronization signal period, the GCK signal includes two clock pulses, and the OE signal includes one pulse in a first potential.

S600: A gate drive circuit processes the OE signal and the GCK signal to generate the gate drive signal.

In scanning the odd field, at a first time period corresponding to the first clock pulse, the gate drive circuit outputs the gate drive signal in a high potential to turn on and write a line of the data drive signal in one of odd-line gate buses, and at a second time period corresponding to the second clock pulse, the gate drive circuit outputs the gate drive signal in a low potential to turn off one of even-line gate buses.

In scanning the even field, at the first time period, the gate drive circuit outputs the gate drive signal in the low potential to turn off one of the odd-line gate buses, and at the second time period, the gate drive circuit outputs the gate drive signal in the high potential to turn on and write a line of the data drive signal in one of the even-line gate buses.

Figure 19:
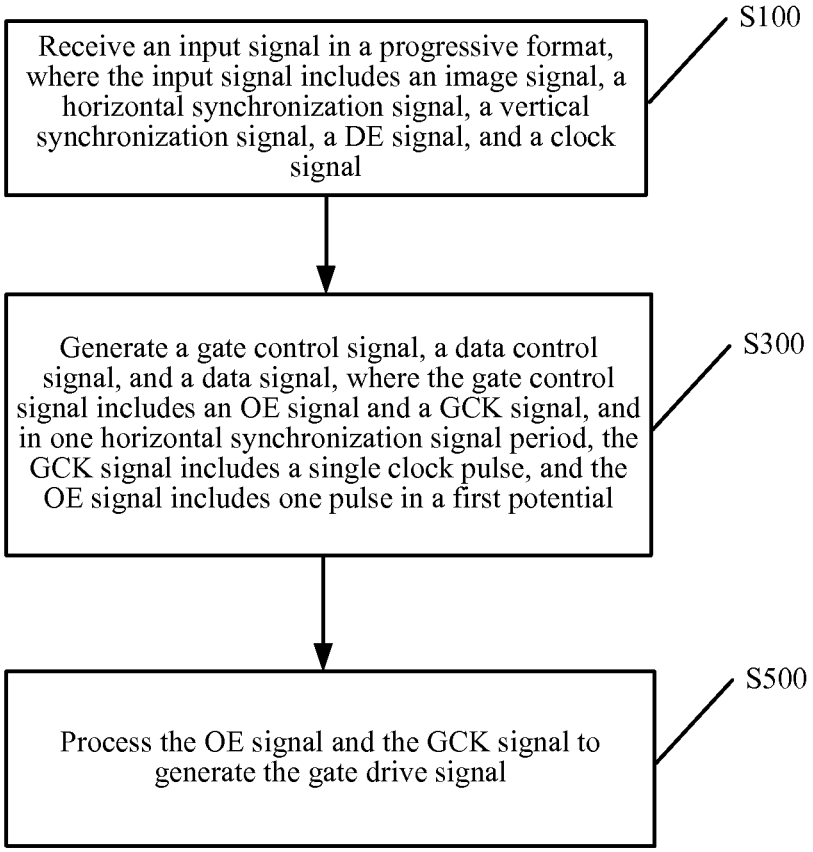
FIG. 19 shows an image display method of a progressive signal according to one embodiment of the present invention.

FIG. 19 shows an image display method of a progressive signal according to one embodiment of the present invention. As shown in FIG. 19, Step S30 includes:

S100: Receive an input signal in a progressive format, where the input signal includes an image signal, a horizontal synchronization signal, a vertical synchronization signal, a DE signal, and a clock signal.

S300: Generate a gate control signal, a data control signal, and a data signal, where the gate control signal includes an OE signal and a GCK signal, and in one horizontal synchronization signal period, the GCK signal includes a single clock pulse, and the OE signal includes one pulse in a first potential.

S500: Process the OE signal and the GCK signal to generate the gate drive signal.

Embodiment 2

The difference between Embodiment 2 and Embodiment 1 lies in the operational method for receiving an interlaced signal by a timing controller.

A video data input signal received by the receiving unit 41 is interlaced-format video data, where the interlaced-format video data includes odd-field data and even-field data. The timing processing unit 43 performs timing processing according to the input signal, which includes the horizontal synchronization signal (Hsync), the vertical synchronization signal (Vsync), and the clock signal, and then outputs a gate control signal including an OE signal, a GCK signal, and a GSP signal.

In scanning the odd field, in the gate drive signal, a first potential pulse of the OE signal counteracts the second clock pulse in the two clock pulses included in the GCK signal, where the first width of the first clock pulse of the two clock pulses of the GCK signal is greater than the second width of the second clock pulse.

In scanning the even field, the first potential pulse of the OE signal counteracts the first clock pulse in the two clock pulses of the GCK signal, where the first width of the first clock pulse of the two clock pulses of the GCK signal is smaller than the second width of the second clock pulse.

In a preferred Embodiment 2 of the present invention, when interlaced scanning and displaying is performed on the interlaced signal, in a data signal period in one line, two gate scanning clock signals are generated, and two lines of gate buses need to be scanned. For example, for 1920*540/240 Hz interlaced image data, the timing processing unit 43 generates two GCK signals at the same time, which results in a double frame frequency when the display device progressively scans the data. One of ordinary skill in the art knows that the display screen having a higher scanning frequency has a longer liquid crystal molecules response time. However, the liquid crystal molecules response time is determined by the characteristics of the liquid crystal screen. In a case where the scanning frequency is improved, in order to reduce the effect brought by the liquid crystal molecules response time, in the Embodiment 2, in scanning the odd-line image, within a data scanning period in one line, the odd-line gate bus is turned on, and the first width of a corresponding clock pulse is greater than the second width of the clock pulse corresponding to the even-line gate bus; in scanning the even-line image, within a data scanning period in one line, the even-line gate bus is turned on, and the second width of the corresponding clock pulse is greater than the first width of the clock pulse corresponding to the odd-line gate bus. In this way, in comparison with the Embodiment 1, in an interlaced scanning mode, in the image scanning line, the time consumed in turning on the gate bus is prolonged, and there is plenty of time for the liquid crystal molecules in the image scanning line to be activated to a stable state, thereby reducing the trailing effect brought by the liquid crystal molecules response time.

First Implementation

FIG. 20 is a first schematic diagram showing the timing processing unit generating a gate control signal according to one embodiment of the present invention. As shown in FIG. 20, a received input signal is a 1920*540/240 Hz video data signal, which includes an odd-field signal and an even-files signal, and a data synchronization period in each line is $1/240*540=7.6*10^{-6}$ s. Within one horizontal synchronization signal period $1/240*540=7.6*10^{-6}$ s, a GCK signal, which includes two clock pulses, and an OE signal, which includes a pulse in the high potential, are generated.

Figure 21:
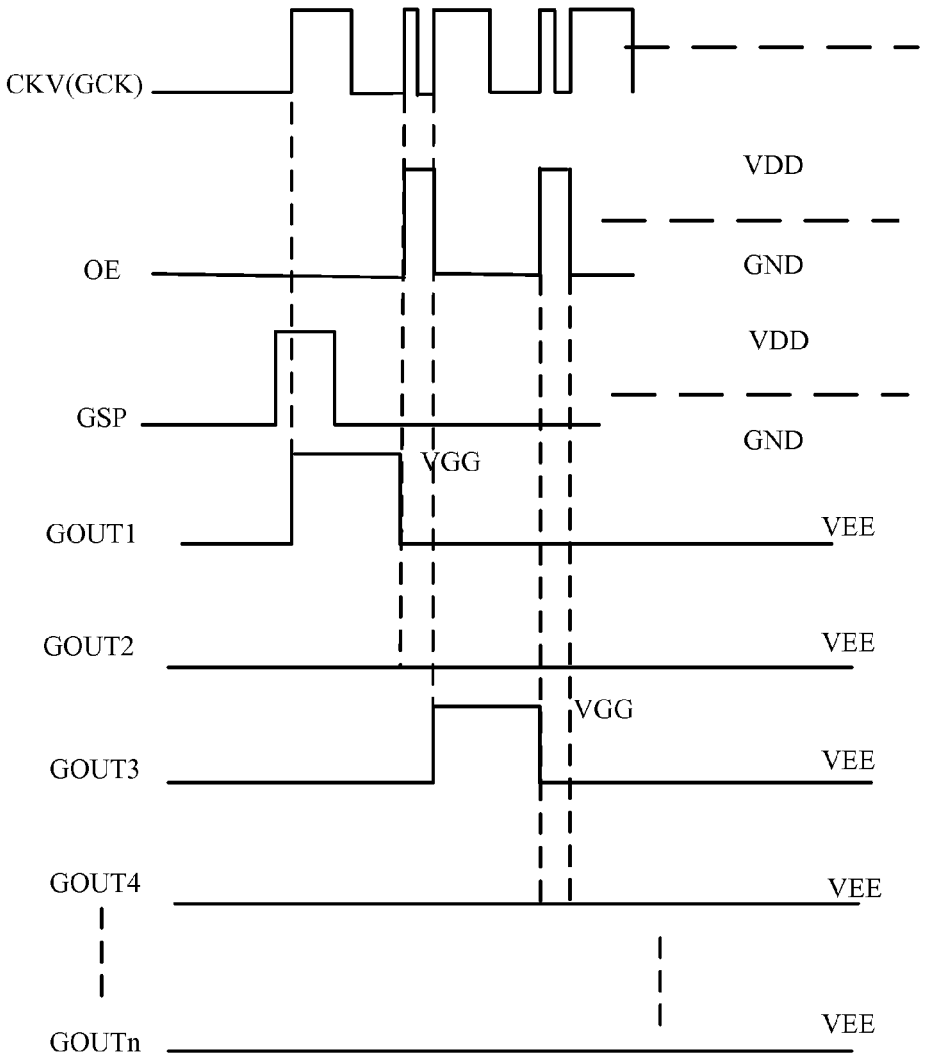
FIG. 21 is a first schematic diagram showing a signal processing procedure by a gate drive circuit for an odd-field signal according to one embodiment of the present invention.

Specifically, with reference to FIG. 20 and FIG. 21, a 1920*540/240 Hz odd-field signal is received, and a data period in each line is $1/240*540=7.6*10^{-6}$ s. When the timing processing unit 43 performs timing processing to output the GCK signal, within the image signal sending period of $7.6*10^{-6}$ s, two pulses of the GCK signals are generated, which include a previous first large clock signal CLK1 having a pulse period being t1, and a latter second small clock signal CLK2 having a pulse period being t2, where t1>t2 and t1+t2=$7.6*10^{-6}$ s. Correspondingly, within the data period $1/240*540=7.6*10^{-6}$ s in each line, in the second time period corresponding to the second small clock signal CLK2, an OE signal in the high potential is generated, which is capable of covering the second small clock signal CLK2. Further referring to FIG. 9, within a data signal period in each line, the GSP signal generates a shift trigger signal of a shift register and a first large clock pulse CLK1, and the shift register outputs a high potential shift output signal to one input end of the AND gate circuit. Correspondingly, a high potential phase inversion signal of the low potential OE signal is input to the other end of the AND gate circuit. Thus, the AND gate circuit outputs a high potential signal, which is converted into a high potential GOUT(1) through potential conversion. The high potential GOUT(1) drives the first gate bus to turn on. In the second small clock pulse CLK2, the shift register outputs a high potential shift output signal, and the AND gate circuit undergoes logic operation with the high potential shift output signal and a low potential phase-inversion signal of the correspondingly high potential OE signal. Since the OE signal covers the second small clock signal CLK2, the AND gate outputs low potential GOUT(2). The following procedures of the process may be deduced by analogy. In the data period in each line, the output gate drive signal GOUT(n) outputs a high potential in an odd line, and outputs a low potential in an even line. Each of the GOUT signals corresponding to the odd-line gate buses is in a high potential to turn on the corresponding odd-line gate bus and write the image data of one line therein. Each of the GOUT signals corresponding to the even-line gate buses is in a low potential to turn off the corresponding even-line gate bus, and image data in the previous field therein is maintained. Thus, the odd-line image is refreshed and displayed by the odd-field data signal.

Figure 22:
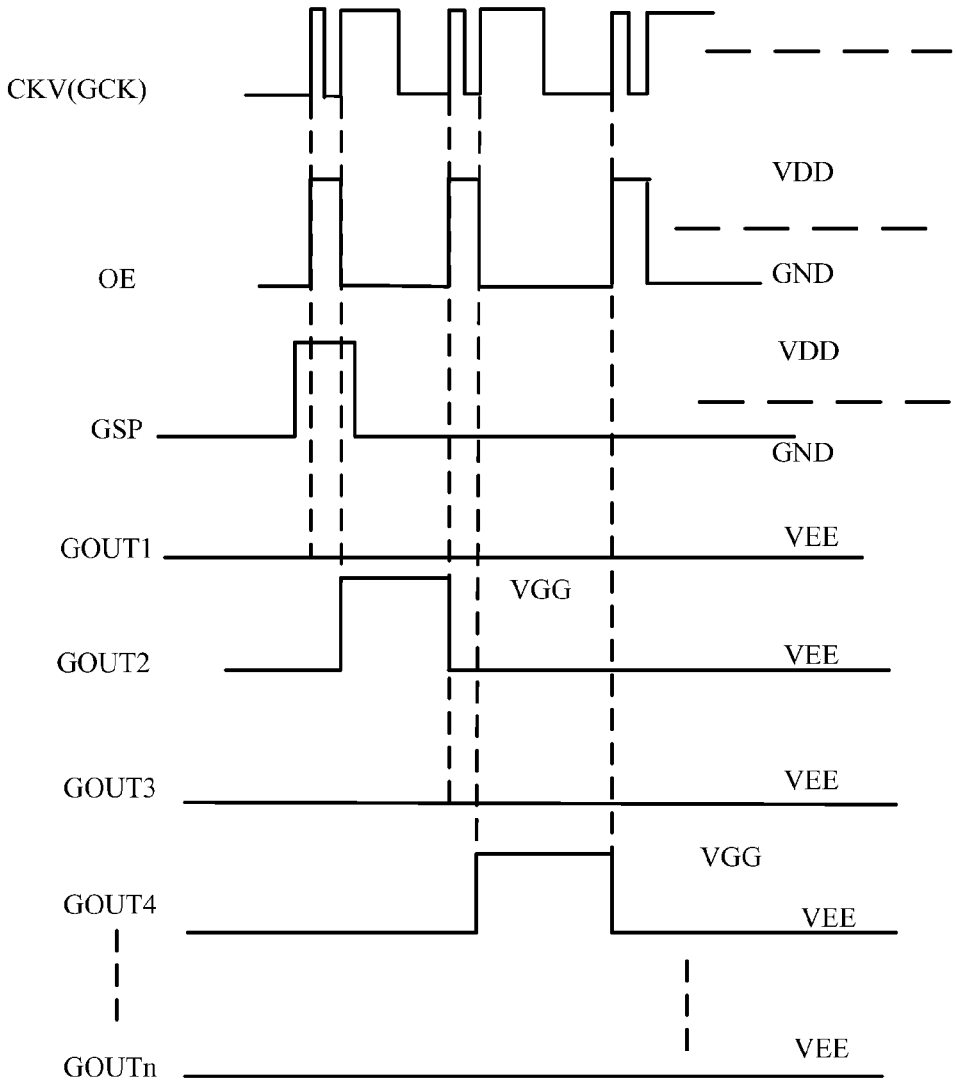
FIG. 22 is a first schematic diagram showing signal processing by the gate drive circuit for an even-field signal according to one embodiment of the present invention.

With reference to FIG. 20 and FIG. 22, a 1920*540/240 Hz odd-field signal is received, and a data period in each line is $1/240*540=7.6*10^{-6}$ s. When the timing processing unit 43 performs timing processing to output the GCK signal, within the image signal sending period of $7.6*10^{-6}$ s, two pulses of the GCK signals are generated, which include a previous first small clock signal CLK2 having a pulse period being t2, and a latter second large clock signal CLK1 having a pulse period being t1, where t1>t2 and t1+t2=$7.6*10^{-6}$ s. Correspondingly, within the data period $1/240*540=7.6*10^{-6}$ s in each line, in the first time period corresponding to the first small clock signal CLK2, an OE signal in the high potential is generated, which is capable of covering the first small clock signal CLK2. Further referring to FIG. 9, within a data signal period in each line, the GSP signal generates a shift trigger signal of a shift register and a first small clock pulse CLK2, and the shift register outputs a high potential shift output signal to one input end of the AND gate circuit. Correspondingly, a low potential phase inversion signal of the high potential OE signal is input to the other end of the AND gate circuit. Since the OE signal covers the first small clock signal CLK2, the AND gate outputs a low potential signal, which is converted into a low potential GOUT(1) through potential conversion. In the second large clock pulse CLK1, the shift register outputs a high potential shift output signal, and the AND gate circuit undergoes logic operation with the high potential shift output signal and a high potential phase-inversion signal of the correspondingly low potential OE signal. Thus, the AND gate outputs a high potential GOUT(2). The following procedures of the process may be deduced by analogy. In the data period in each line, the output gate drive signal GOUT (n) outputs a low potential in an odd line, and outputs a high potential in an even line. Each of the GOUT signals corresponding to the odd-line gate buses is in a low potential to turn off the corresponding odd-line gate bus, and image data in the previous field therein is maintained. Each of the GOUT signals corresponding to the even-line gate buses is in a low potential to turn on the corresponding even-line gate bus and write the image data of one line therein. Thus, the even-line image is refreshed and displayed by the even-field data signal.

In the first implementation of the Embodiment 2, by receiving the odd-field signal, the odd-line image can be refreshed and displayed, and the even line maintains the previous even-field image. By receiving the even-field signal, the even-line image can be refreshed and displayed, and the odd line maintains the previous even-field image.

Second Implementation

Figure 23:
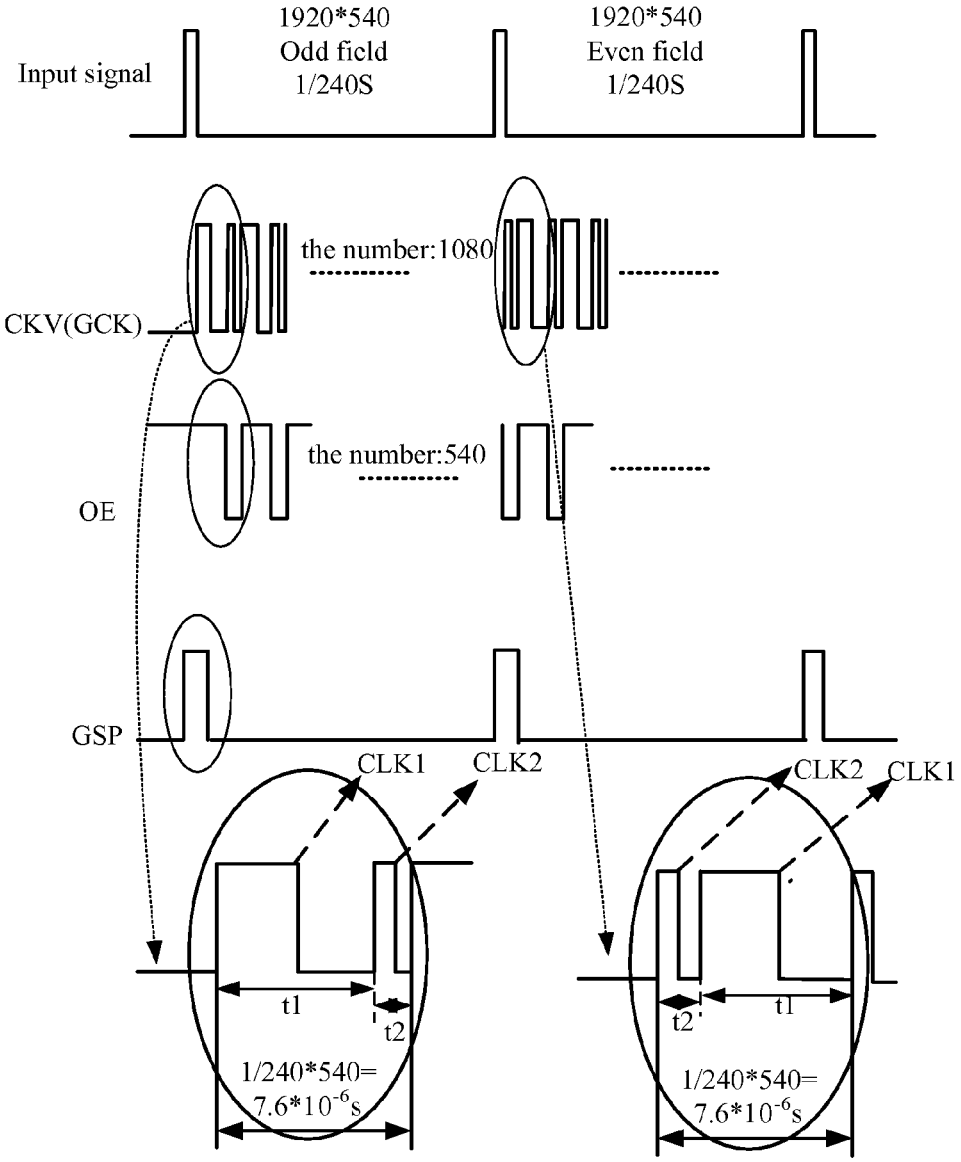
FIG. 23 is a second schematic diagram showing the timing processing unit generating a gate control signal according to one embodiment of the present invention.

FIG. 23 is a second schematic diagram showing the timing processing unit generating a gate control signal according to one embodiment of the present invention. As shown in FIG. 23, a received input signal is a 1920*540/240 Hz video data signal, which includes an odd-field signal and an even-files signal, and a data synchronization period in each line is $1/240*540=7.6*10^{-6}$ s. Within one horizontal synchronization signal period $1/240*540=7.6*10^{-6}$ s, a GCK signal, which includes two clock pulses, and an OE signal, which includes a pulse in the low potential, are generated.

Figure 24:
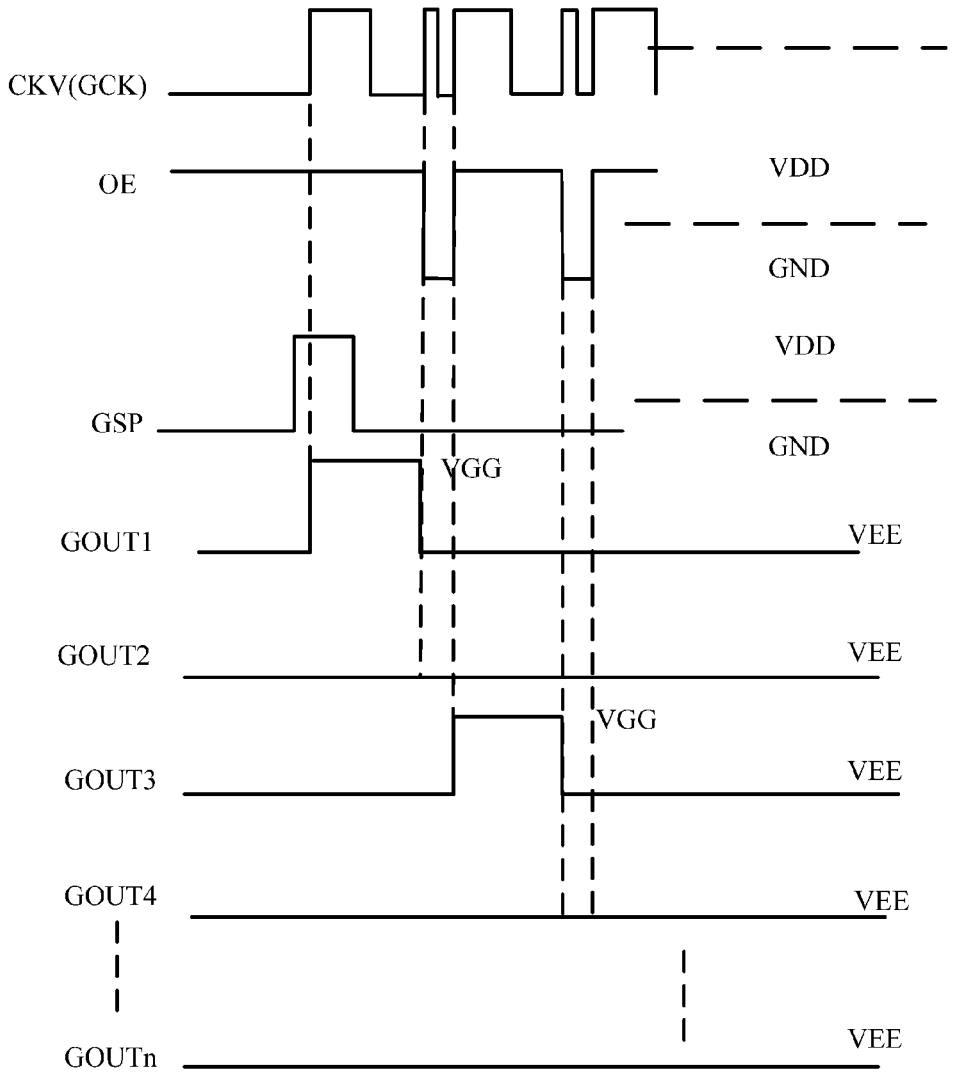
FIG. 24 is a schematic diagram showing signal processing by a gate drive circuit for an odd-field signal according to one embodiment of the present invention.

Specifically, with reference to FIG. 23 and FIG. 24, a 1920*540/240 Hz odd-field signal is received, and a data period in each line is $1/240*540=7.6*10^{-6}$ s. When the timing processing unit 43 performs timing processing to output the GCK signal, within the image signal sending period of $7.6*10^{-6}$ s, two pulses of the GCK signals are generated, which include a previous first large clock signal CLK1 having a pulse period being t1, and a latter second small clock signal CLK2 having a pulse period being t2, where t1>t2 and t1+t2=$7.6*10^{-6}$ s. Correspondingly, within the data period $1/240*540=7.6*10^{-6}$ s in each line, in the first time period corresponding to the second small clock signal CLK2, an OE signal in the low potential is generated, which is capable of covering the second small clock signal CLK2. Further referring to FIG. 12, within a data signal period in the first line, the GSP signal generates a shift trigger signal of a shift register and a first large clock pulse CLK1, and the shift register outputs a high potential shift output signal to one input end of the AND gate circuit. Correspondingly, a high potential OE signal is input to the other end of the AND gate circuit. Thus, the AND gate circuit outputs a high potential signal, which is converted into a high potential GOUT(1) through potential conversion. In the second small clock pulse CLK2, the shift register outputs a high potential shift output signal, and the AND gate circuit undergoes logic operation with the high potential shift output signal and a low potential OE signal. Since the OE signal covers the second small clock signal CLK2, the AND gate outputs low potential GOUT(2). The following procedures of the process may be deduced by analogy. In the data period in each line, the output gate drive signal GOUT (n) outputs a high potential in an odd line, and outputs a low potential in an even line. Each of the GOUT signals corresponding to the odd-line gate buses is in a high potential to turn on the corresponding odd-line gate bus and write the image data of one line therein. Each of the GOUT signals corresponding to the even-line gate buses is in a low potential to turn off the corresponding even-line gate bus, and image data in the previous field therein is maintained. Thus, the odd-line image is refreshed and displayed by the odd-field data signal.

Figure 25:
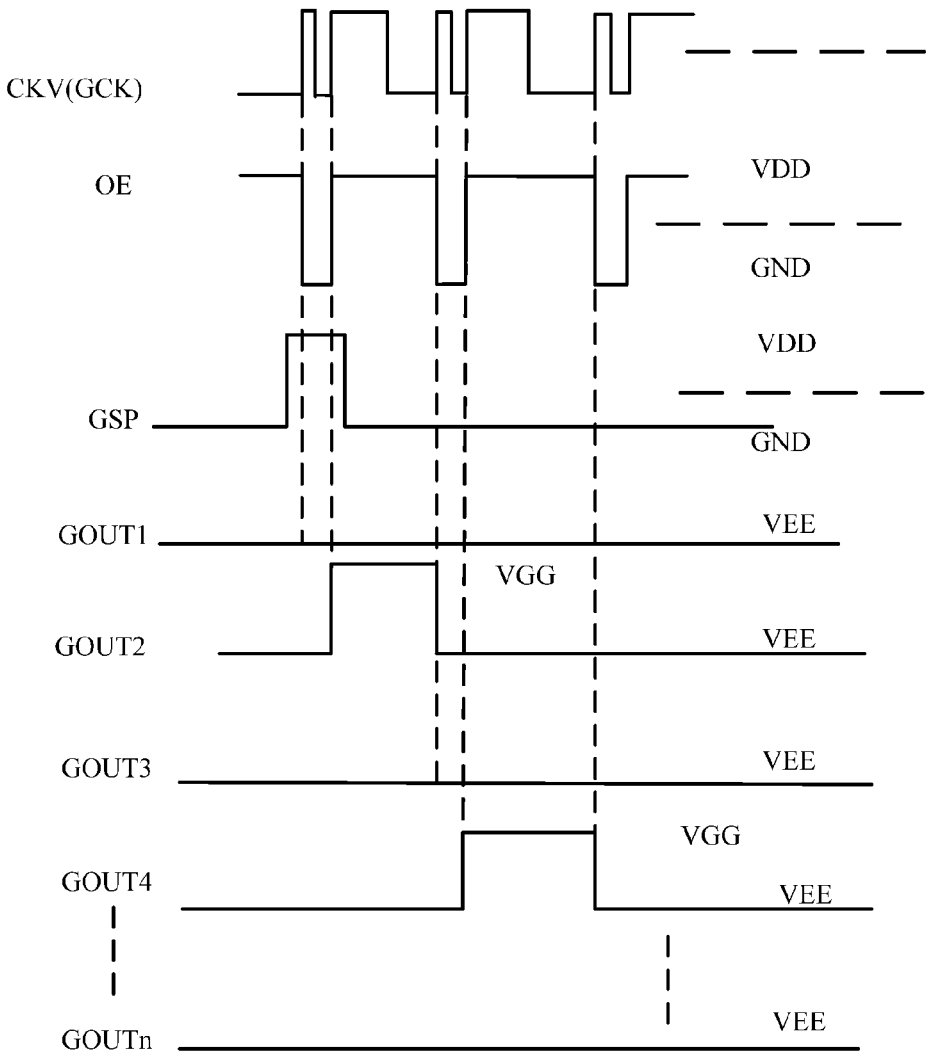
FIG. 25 is a second schematic diagram showing signal processing by the gate drive circuit for an even-field signal according to one embodiment of the present invention.

With reference to FIG. 23 and FIG. 25, a 1920*540/240 Hz odd-field signal is received, and a data period in each line is $1/240*540=7.6*10^{-6}$ s. When the timing processing unit 43 performs timing processing to output the GCK signal, within the image signal sending period of $7.6*10^{-6}$ s, two pulses of the GCK signals are generated, which include a previous first small clock signal CLK2 having a pulse period being t2, and a latter second large clock signal CLK1 having a pulse period being t1, where t1>t2 and t1+t2=$7.6*10^{-6}$ s. Correspondingly, within the data period $1/240*540=7.6*10^{-6}$ s in each line, in the first time period corresponding to the first small clock signal CLK2, an OE signal in the low potential is generated, which is capable of covering the first small clock signal CLK2. Further referring to FIG. 12, within a data signal period in each line, the GSP signal generates a shift trigger signal of a shift register and a first small clock pulse CLK2, and the shift register outputs a high potential shift output signal to one input end of the AND gate circuit. Correspondingly, a low potential OE signal is input to the other end of the AND gate circuit. Since the OE signal covers the first small clock signal CLK2, the AND gate outputs a low potential signal, which is converted into a low potential GOUT(1) through potential conversion. In the second large clock pulse CLK1, the shift register outputs a high potential shift output signal, and the AND gate circuit undergoes logic operation with the high potential shift output signal and a high potential OE signal. Thus, the AND gate outputs a high potential GOUT(2). The following procedures of the process may be deduced by analogy. In the data period in each line, the output gate drive signal GOUT (n) outputs a low potential in an odd line, and outputs a high potential in an even line. Each of the GOUT signals corresponding to the odd-line gate buses is in a low potential to turn off the corresponding odd-line gate bus, and image data in the previous field therein is maintained. Each of the GOUT signals corresponding to the even-line gate buses is in a low potential to turn on the corresponding even-line gate bus and write the image data of one line therein. Thus, the even-line image is refreshed and displayed by the even-field data signal.

In the second implementation of the Embodiment 2, by receiving the odd-field signal, the odd-line image can be refreshed and displayed, and the even line maintains the previous even-field image. By receiving the even-field signal, the even-line image can be refreshed and displayed, and the odd line maintains the previous even-field image.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A display device, comprising:

a liquid crystal panel;

a gate drive circuit, configured to provide a gate drive signal to the liquid crystal panel;

a data drive circuit, configured to provide a data drive signal to the liquid crystal panel; and a timing controller, configured to receive a frame of an input signal comprising an odd-field signal and an even-field signal, to provide a data control signal and a data signal to the data drive circuit, and to provide a gate control signal to the gate drive circuit, wherein the gate control signal comprises an output enable (OE) signal and a gate scanning clock (GCK) signal, wherein in a period of the data signal in one line, the GCK signal comprises two clock pulses having a first clock pulse and a second clock pulse, and the OE signal comprises one pulse signal;

wherein in scanning the odd field, at a first time period corresponding to the first clock pulse of the two clock pulses of the GCK signal, the gate drive circuit outputs the gate drive signal in a high potential to drive one of odd-line gate buses, and at a second time period corresponding to the second clock pulse of the two clock pulses of the GCK signal, the gate drive circuit outputs the gate drive signal in a low potential to drive one of even-line gate buses; and wherein in scanning the even field, at the first time period, the gate drive circuit outputs the gate drive signal in the low potential to drive one of the odd-line gate buses, and at the second time period, the gate drive circuit outputs the gate drive signal in the high potential to drive one of the even-line gate buses.

2. The display device according to claim 1, wherein in scanning the odd field, the pulse signal of the OE signal counteracts the second clock pulse of the two clock pulses, such that the gate drive signal to drive the even-line gate buses is in the low potential at the second time period; and in scanning the even field, the pulse signal of the OE signal counteracts the first clock pulse of the two clock pulses, such that the gate drive signal to drive the odd-line gate buses is in the low potential at the first time period.

3. The display device according to claim 1, wherein in scanning the odd field, a first width of the first clock pulse of the GCK signal is greater than a second width of the second clock pulse of the GCK signal; and in scanning the even field, the first width of the first clock pulse of the GCK signal is smaller than the second width of the second clock pulse of the GCK signal.

4. The display device according to claim 1, wherein the timing controller comprises:

a receiving unit, configured to receive the input signal;

an image data processing unit, configured to generate the data signal according to the input signal, and to output the data signal to the data drive circuit; and a timing processing unit, configured to generate the data control signal and the gate control signal according to the input signal, to output the data control signal to the data drive circuit, and to output the gate control signal to the gate drive circuit.

5. The display device according to claim 4, wherein the time processing unit is further configured to generate a gate start pulse (GSP) signal.

6. The display device according to claim 5, wherein the gate drive circuit comprises:

a shift register, configured to receive the GCK signal as a shift clock signal, to receive the GSP signal as a shift trigger signal, and to generate a shift output signal; and an AND gate circuit, having a first input end configured to receive the shift output signal from the shift register, and a second input end configured to receive a phase inversion signal of the OE signal, wherein the AND gate circuit is configured to perform an AND logic process on the shift output signal and the phase inversion signal to generate an output signal as the gate drive signal.

7. The display device according to claim 6, further comprising:

an inverter connected between an output end of the timing controller outputting the OE signal and an input end of the AND gate circuit, configured to perform phase-inversion processing on the OE signal to generate the phase inversion signal;

wherein the pulse signal of the OE signal is in a high potential such that the phase inversion signal is in a low potential, the shift output signal is in the high potential, and the AND gate circuit is configured to generate the output signal in the low potential.

8. The display device according to claim 5, wherein gate drive circuit comprises:

a shift register, configured to receive the GCK signal as a shift clock signal, to receive the GSP signal as a shift trigger signal, and to generate a shift output signal; and an AND gate circuit, having a first input end configured to receive the shift output signal from the shift register, and a second input end configured to receive the OE signal, wherein the AND gate circuit is configured to perform an AND logic process on the shift output signal and the OE signal to generate an output signal as the gate drive signal.

9. The display device according to claim 8, wherein the pulse signal of the OE signal is in a low potential, the shift output signal is in a high potential, and the AND gate circuit is configured to generate the output signal in the low potential.

10. The display device according to claim 4, wherein the input signal received by the receiving unit comprises an image signal, a horizontal synchronization signal, a vertical synchronization signal, a data enable (DE) signal, and a clock signal; and the image data processing unit is further configured to, when generating the data signal, output a line of an image data signal in a period of the horizontal synchronization signal.

11. A display device, comprising:

a liquid crystal panel;

a gate drive circuit, configured to provide a gate drive signal to the liquid crystal panel;

a data drive circuit, configured to provide a data drive signal to the liquid crystal panel; and an interlaced and progressive format determination unit, configured to determine an input signal as a progressive image signal or an interlaced image signal comprising an odd-field signal and an even-field signal, to output a first control signal when the input signal is determined as the interlaced image signal, and to output a second control signal when the input signal is determined as the progressive image signal; and a timing controller, configured to receive the input signal, to receive the first control signal or the second control signal from the interlaced and progressive format determination unit, to provide a data control signal and a data signal to the data drive circuit, and to provide a gate control signal to the gate drive circuit, wherein the gate control signal comprises an output enable (OE) signal and a gate scanning clock (GCK) signal;

wherein when the timing controller receives the first control signal, the timing controller generates, in a period of the data signal in one line, the GCK signal comprising two clock pulses having a first clock pulse and a second clock pulse, and the OE signal comprising one pulse signal, wherein in scanning the odd field, at a first time period corresponding to the first clock pulse of the GCK signal, the gate drive circuit outputs the gate drive signal in a high potential to drive one of odd-line gate buses, and at a second time period corresponding to the second clock pulse of the GCK signal, the gate drive circuit outputs the gate drive signal in a low potential to drive one of even-line gate buses, and wherein in scanning the even field, at the first time period, the gate drive circuit outputs the gate drive signal in the low potential to drive one of the odd-line gate buses, and at the second time period, the gate drive circuit outputs the gate drive signal in the high potential to drive one of the even-line gate buses; and wherein when the timing controller receives the second control signal, the timing controller generates, in the period of the data signal in one line, the GCK signal comprising a single clock pulse, and the OE signal having a first potential.

12. The display device according to claim 11, wherein in scanning the odd field, a first width of the first clock pulse of the GCK signal is greater than a second width of the second clock pulse of the GCK signal; and in scanning the even field, the first width of the first clock pulse of the GCK signal is smaller than the second width of the second clock pulse of the GCK signal.

13. The display device according to claim 11, wherein the timing controller is further configured to generate a gate start pulse (GSP) signal;

wherein the gate drive circuit comprises:

a shift register, configured to receive the GCK signal as a shift clock signal, to receive the GSP signal as a shift trigger signal, and to generate a shift output signal; and an AND gate circuit, having a first input end configured to receive the shift output signal from the shift register, and a second input end configured to receive a phase inversion signal of the OE signal, wherein the AND gate circuit is configured to perform an AND logic process on the shift output signal and the phase inversion signal to generate an output signal as the gate drive signal.

14. The display device according to claim 13, further comprising:

an inverter connected between an output end of the timing controller outputting the OE signal and an input end of the AND gate circuit, configured to perform phase-inversion processing on the OE signal to generate the phase inversion signal;

wherein when the timing controller receives the first control signal, the pulse signal of the OE signal is in a high potential such that the phase inversion signal is in a low potential, the shift output signal is in the high potential, and the AND gate circuit is configured to generate the output signal in the low potential;

wherein when the timing controller receives the second control signal, the first potential of the OE signal is in the low potential such that the phase inversion signal is in the high potential, the shift output signal is in the high potential, and the AND gate circuit is configured to generate the output signal in the high potential.

15. The display device according to claim 11, wherein the timing controller is further configured to generate a gate start pulse (GSP) signal;

wherein the gate drive circuit comprises:

a shift register, configured to receive the GCK signal as a shift clock signal, to receive the GSP signal as a shift trigger signal, and to generate a shift output signal; and an AND gate circuit, having a first input end configured to receive the shift output signal from the shift register, and a second input end configured to receive the OE signal, wherein the AND gate circuit is configured to perform an AND logic process on the shift output signal and the OE signal to generate an output signal as the gate drive signal.

16. The display device according to claim 15, wherein when the timing controller receives the first control signal, the pulse signal of the OE signal is in a low potential, the shift output signal is in a high potential, and the AND gate circuit is configured to generate the output signal in the low potential; and when the timing controller receives the second control signal, the first potential of the OE signal is the high potential, the shift output signal is in the high potential, and the AND gate circuit is configured to generate the output signal in the high potential.

17. An image displaying method applicable to a display device driven by a gate drive signal and a data drive signal, the method comprising:

(a) receiving, by a timing controller, an input signal;

(b) generating a gate control signal, a data control signal, and a data signal, wherein the gate control signal comprises an output enable (OE) signal and a gate scanning clock (GCK) signal; and (c) processing, by a gate drive circuit, the OE signal and the GCK signal to generate the gate drive signal;

wherein when the input signal comprises an odd-field signal and an even-field signal, in a period of the data signal in one line, the GCK signal comprises two clock pulses having a first cloak clock pulse and a second clock pulse, and the OE signal comprises one pulse signal;

in scanning the odd field, at a first time period corresponding to the first clock pulse of the GCK signal, the gate drive circuit outputs the gate drive signal in a high potential to turn on and write a line of the data drive signal in one of odd-line gate buses, and at a second time period corresponding to the second clock pulse of the GCK signal, the gate drive circuit outputs the gate drive signal in a low potential to turn off one of even-line gate buses; and in scanning the even field, at the first time period, the gate drive circuit outputs the gate drive signal in the low potential to turn off one of the odd-line gate buses, and at the second time period, the gate drive circuit outputs the gate drive signal in the high potential to turn on and write a line of the data drive signal in one of the even-line gate buses.

18. The image displaying method according to claim 17, wherein in scanning the odd field, a first width of the first clock pulse of the GCK signal is greater than a second width of the second clock pulse of the GCK signal; and in scanning the even field, the first width of the first clock pulse of the GCK signal is smaller than the second width of the second clock pulse of the GCK signal.

19. The image display method according to claim 17, further comprising:

determining the input signal as an interlaced signal or a progressive signal;

when the input signal comprises the odd-field signal and the even-field signal, determining the input signal as the interlaced signal, and performing steps (a), (b) and (c); and when the input signal is in a progressive format, determining the input signal as a progressive signal, and performing steps (a), (b) and (c), wherein in the period of the data signal in one line, the GCK signal comprises a single clock pulse, and the OE signal is in a first potential.

* * * * *